US009215776B2

(12) United States Patent
Iwahashi et al.

(10) Patent No.: US 9,215,776 B2
(45) Date of Patent: Dec. 15, 2015

(54) LIGHTING EQUIPMENT, ILLUMINATION DEVICE AND LIGHT EMITTING MODULE

(71) Applicant: Panasonic Intellectual Property Management Co., Ltd., Osaka (JP)

(72) Inventors: Tomoya Iwahashi, Osaka (JP); Kohji Hiramatsu, Osaka (JP); Naoko Takei, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/434,962

(22) PCT Filed: Oct. 4, 2013

(86) PCT No.: PCT/JP2013/005917

§ 371 (c)(1),
(2) Date: Apr. 10, 2015

(87) PCT Pub. No.: WO2014/057635

PCT Pub. Date: Apr. 17, 2014

(65) Prior Publication Data

US 2015/0264772 A1 Sep. 17, 2015

(30) Foreign Application Priority Data

Oct. 12, 2012 (JP) ..... 2012-226814

(51) Int. Cl.
*H05B 33/08* (2006.01)
*F21K 99/00* (2010.01)
(Continued)

(52) U.S. Cl.
CPC ..... *H05B 33/0857* (2013.01); *F21K 9/135* (2013.01); *F21K 9/17* (2013.01);
(Continued)

(58) Field of Classification Search
USPC ..... 315/152, 307, 308, 312
See application file for complete search history.

(56) References Cited

U.S. PATENT DOCUMENTS

2009/0224693 A1 9/2009 Mukai et al.
2015/0070887 A1* 3/2015 Yamauchi ..... F21K 9/135 362/231
2015/0263246 A1* 9/2015 Hiramatsu ..... H01L 33/507 362/231

FOREIGN PATENT DOCUMENTS

JP 2006-164879 A 6/2006
JP 2006-253502 A 9/2006
(Continued)

OTHER PUBLICATIONS

New Handbook for Color Science [3rd Edition] (Color Science Association of Japan), with partial English translation, 5 pages.
(Continued)

*Primary Examiner* — Don Le
(74) *Attorney, Agent, or Firm* — McDermott Will & Emery LLP

(57) ABSTRACT

Lighting equipment 1 is provided that enables illumination light having a stable FCI to be obtained, without influence from the lighting conditions. To this end, a lighting circuit 4 performs control of lighting a first red light source R1 and lighting a white light source W while not lighting or faintly lighting a second red light source R2 under first lighting conditions in which the first red light source R1 is expected to produce red light with a first peak wavelength, and of lighting the second red light source R2 and lighting the white light source W while not lighting or faintly lighting the first red light source R1 under second lighting conditions in which the first red light source R1 is expected to produce the red light with a second peak wavelength that is shifted toward a longer wavelength relative to the first peak wavelength.

7 Claims, 21 Drawing Sheets

(51) Int. Cl.

| | |
|---|---|
| ***F21V 9/16*** | (2006.01) |
| *F21S 8/02* | (2006.01) |
| *F21Y 101/02* | (2006.01) |
| *F21Y 103/00* | (2006.01) |
| *F21Y 105/00* | (2006.01) |
| *F21Y 113/00* | (2006.01) |

(52) U.S. Cl.

CPC .. *F21K 9/30* (2013.01); *F21K 9/56* (2013.01); *F21V 9/16* (2013.01); *H05B 33/086* (2013.01); *F21S 8/026* (2013.01); *F21Y 2101/02* (2013.01); *F21Y 2101/025* (2013.01); *F21Y 2103/003* (2013.01); *F21Y 2105/003* (2013.01); *F21Y 2113/005* (2013.01)

(56) References Cited

FOREIGN PATENT DOCUMENTS

| | | | |
|---|---|---|---|
| JP | 2007-218942 | A | 8/2007 |
| JP | 2009-065137 | A | 3/2009 |
| JP | 2011-066108 | A | 3/2011 |
| JP | 2012-064888 | A | 3/2012 |

OTHER PUBLICATIONS

International Search Report issued in PCT/JP2013/005917, dated Jan. 14, 2014, with English translation.

* cited by examiner

LIGHTING EQUIPMENT, ILLUMINATION DEVICE AND LIGHT EMITTING MODULE

RELATED APPLICATIONS

This application is the U.S. National Phase under 35 U.S.C. §371 of International Application No. PCT/JP2013/005917, filed on Oct. 4, 2013, which in turn claims the benefit of Japanese Application No. 2012-226814, filed on Oct. 12, 2012, the disclosures of which Applications are incorporated by reference herein.

TECHNICAL FIELD

The present disclosure pertains to lighting equipment, an illumination device, and a light emitting module using a light-emitting element such as a light-emitting diode (hereinafter, LED), and particularly pertains to technology improving light characteristics in illumination light from such lighting equipment.

BACKGROUND ART

Conventionally, a white light source has been realized that generates white light by converting a portion of blue light emitted by a blue LED into yellow light by using a wavelength converter, and mixing the blue light with the yellow light. Various types of lighting equipment utilizing such a white light source have been commercialized.

However, lighting equipment using the above-described white light source is likely to produce illumination light not achieving desirable appearance of objects. This occurs because the illumination light of the white light source does not contain a sufficient red light component, which leads to the appearance of objects not being desirable.

Thus, proposals have been made for improving illumination light in terms of how objects appear therein by adding a red light source of red light to the white light source of white light, thereby supplementing the red light component (see Patent Literature 1).

CITATION LIST

Patent Literature

[Patent Literature 1]
Japanese Unexamined Patent Application Publication No. 2012-64888

Non-Patent Literature

[Non-Patent Literature 1]
New Edition Handbook of Color Science (3rd Edition), The Color Science Association of Japan

SUMMARY OF INVENTION

Technical Problem

However, upon actually manufacturing and lighting equipment that combines a white light source and a red light source, a phenomenon has been observed where the appearance of objects in illumination light changes in response to lighting conditions when a red LED is used as the red light source. That is, simply combining the white light source and the red light source poses difficulties in terms of maintaining desirable appearance of objects under various lighting conditions.

In consideration of the above problem, the present disclosure aims to provide lighting equipment, an illumination device, and a light emitting module that are able to produce illumination light achieving desirable appearance of objects, unaffected by the lighting conditions.

Solution to Problem

In order to achieve the above-described aim, lighting equipment, an illumination device, and a light emitting module provide a white light source including a light-emitting element and a wavelength converter member performing wavelength conversion on light from the light-emitting element, the white light source producing white light obtained by combining light from the light-emitting element that is converted by the wavelength converter member and light from the light-emitting element that is not converted by the wavelength converter member, a first red light source producing first red light, a second red light source producing second red light having an emission peak at a shorter wavelength than the first red light source when lit under similar lighting conditions, and a lighting circuit performing lighting control of the white light source, the first red light source, and the second red light source, the lighting circuit performing control of lighting the first red light source and lighting the white light source while not lighting the second red light source under first lighting conditions in which the first red light source is expected to produce the first red light with a first peak wavelength, and of lighting the second red light source and lighting the white light source while not lighting the first red light source under second lighting conditions in which the first red light source is expected to produce the first red light with a second peak wavelength that is shifted toward a longer wavelength relative to the first peak wavelength.

In the present disclosure, the terms white, red, blue, yellow, and so on are used to specify light colors. These terms are not intended to strictly conform to the definitions of the Comission Internationale de l'Éclairage (hereinafter, CIE) (e.g., CIE definitions of red as a wavelength of 700 nm, blue as a wavelength of 435.8 nm, and yellow as a wavelength 546.1 nm) and merely specify a wavelength region and range for the light. For this reason, when it is necessary to specify a precise wavelength of light, the wavelength is specified by using a numerical range.

Advantageous Effects of Invention

The lighting equipment, illumination device, and light emitting module pertaining to an aspect of the present disclosure light a first red light source and a white light source but do not light a second red light source when under first lighting conditions in which the first red light source produces first red light having a first peak wavelength. Also, the aspect of the present disclosure lights the second red light source and the white light source but does not light the first red light source when under second lighting conditions in which the first red light source produces first red light having a second peak wavelength shifted toward longer wavelengths relative to the first peak wavelength.

Accordingly, the combination of the first red light source and the white light source and the combination of the second red light source and the white light source are optimized to produce illumination light achieving desirable appearance of objects under the first lighting conditions and the second lighting conditions. As such, the appearance of objects in illumination light is maintained in desirable state without influence from the lighting conditions.

DESCRIPTION OF EMBODIMENT

<Background Leading to Invention>

The Feeling of Contrast Index (hereinafter, FCI) is an index for evaluating how objects appear in illumination light from lighting equipment (see Non-Patent Literature 1). A high FCI evaluation is given to illumination light that causes an illumination target to be perceived with bright colors in a color rendering space.

However, obtaining illumination light with a high FCI is not easy. Specifically, illumination light from lighting equipment using a white light source that obtains white light by combining blue light and yellow light tends to have a low FCI. This is caused by the insufficient red components in the illumination light of the white light source. Insufficient red components result in a low FCI.

The inventors realized, upon actually manufacturing and lighting equipment combining a white light source and a red light source, that the FCI of illumination light changes in response to lighting conditions. For example, the FCI greatly differs between times when the temperature of the light-emitting element is low, such as at initial lighting time, and times when the temperature of the light-emitting element is high, such as after a period time has passed since lighting. The FCI was also observed to change when the current flowing through the light-emitting element for dimming was changed (i.e., a change of brightness). In consideration of these observations, there is a risk that despite optimizing the combination of the white light source and the red light source to obtain a desired FCI under given lighting conditions, the FCI may decrease when the lighting conditions change. Thus, the inventors arrived at developing lighting equipment that enables illumination light having a stable FCI to be obtained, without influence from the lighting conditions.

The inventors then discovered, as a result of various experiments described below, that the cause of the change in FCI is a shift in peak wavelength of the red light. Furthermore, the shift in peak wavelength of the red light was identified as being produced by a change in temperature of the red light-emitting element and by a change in current flowing through the red light-emitting element.

Figure 1:
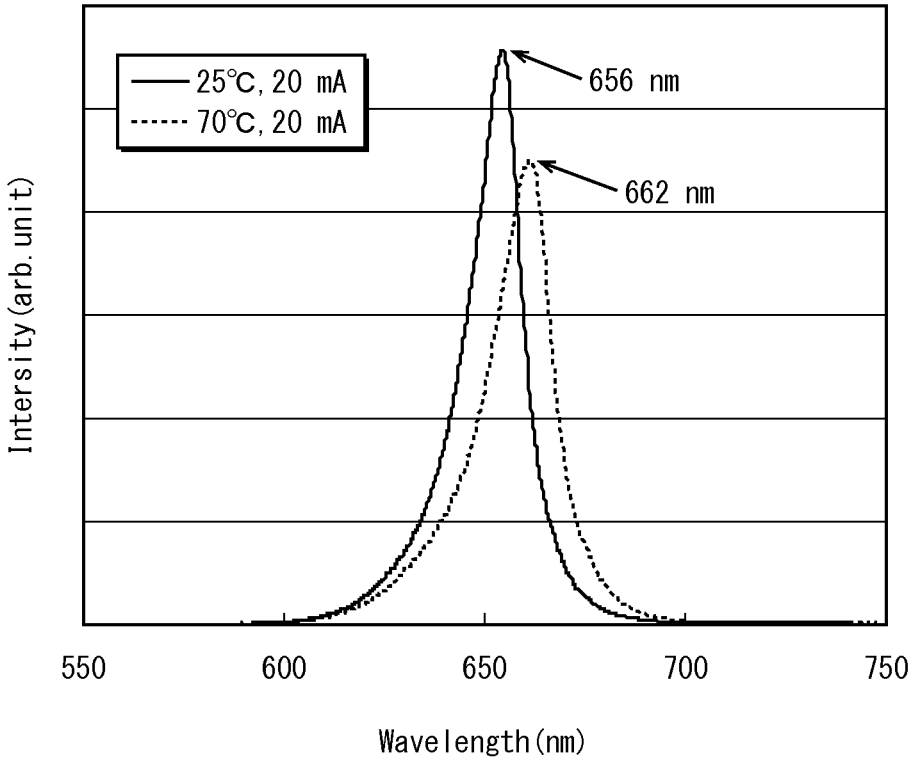
FIG. 1 describes a shift in the peak wavelength of red light toward longer wavelengths as temperature increases.

In a first experiment, the emission spectrum of the red light was measured with the red light-emitting element at a temperature of 25° C. and at a temperature of 70° C. while the current flowing through the red light-emitting element was held constant at 20 mA. FIG. 1 describes the shift in peak wavelength of the red light toward longer wavelengths as the temperature increases. As a result, and as depicted in FIG. 1, the peak wavelength is 656 nm when the temperature is 25° C., and is 662 nm when the temperature is 70° C. That is, a temperature increase of 45° C. produced a shift in the peak wavelength of 6 nm toward longer wavelengths. These results indicated that increasing the temperature of the red light-emitting element shifts the optical peak of the red light toward longer wavelengths.

Figure 2:
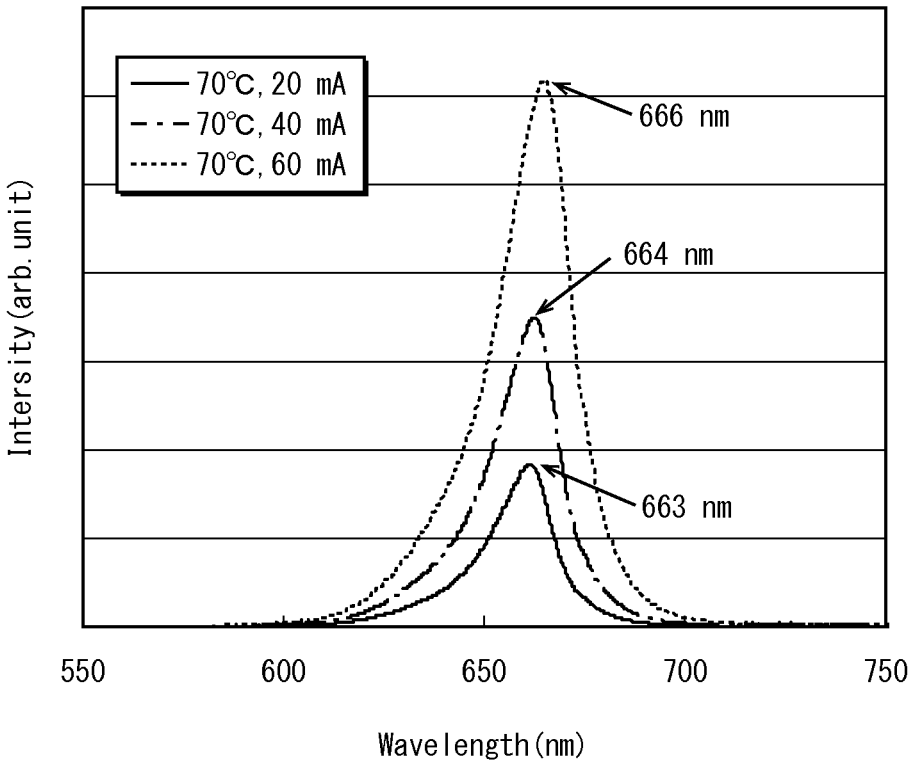
FIG. 2 describes the shift in the peak wavelength of the red light toward longer wavelengths as current increases.

In a second experiment, the emission spectrum of the red light was measured with the current flowing in the red light-emitting element at 20 mA, 40 mA, and 60 mA, while the temperature of the red light-emitting element was held constant at 70° C. FIG. 2 describes the shift in peak wavelength of the red light toward longer wavelengths as the current increases. As a result, as depicted in FIG. 2, the peak wavelength is 663 nm when the current is 20 mA, 664 nm when the current is 40 mA, and 666 nm when the current is 60 mA. That is, increasing the current by 40 mA produced a shift in the peak wavelength of 3 nm toward longer wavelengths. These results indicated that increasing the current flowing in the red light-emitting element also shifts the optical peak of the red light toward longer wavelengths.

Figure 3:
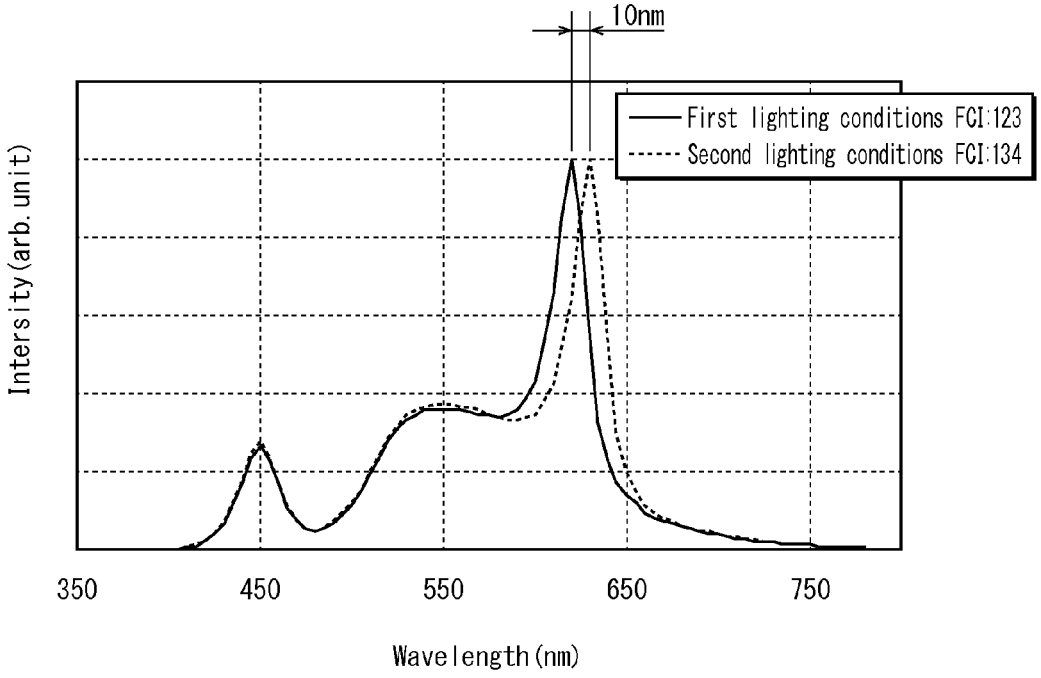
FIG. 3 describes the relationship between the peak wavelength of the red light and FCI.

In a third experiment, conventional lighting equipment combining a white light source and a red light source was manufactured. This lighting equipment was lit under first lighting conditions and under second lighting conditions shifting the peak wavelength of the red light toward longer wavelengths relative to the first lighting conditions. The emission spectrum was measured for the illumination light under these respective conditions. Under the second lighting conditions, the temperature of the red light-emitting element is 45° C. higher and the current flowing in the red light-emitting element is 60 mA higher than under than first lighting conditions. FIG. 3 describes the relationship between the peak wavelength of the red light and the FCI. As a result, as depicted in FIG. 3, changing from the first lighting conditions to the second lighting conditions shifts the peak wavelength of the red light by 10 nm toward longer wavelengths and changes the FCI from 123 to 134. These results indicated that shifting the peak wavelength of the red light by changing the lighting conditions also changed the FCI.

In these experiments, the lighting conditions were changed by increasing the temperature of the red light-emitting element and increasing the current flowing in the red light-emitting element. However, the results of the first experiment suggest that increasing the temperature of the red light-emitting element while the current flowing in the red light-emitting element is held constant, for example, would also change the FCI. Likewise, the results of the second experiment suggest that increasing the current flowing in the red light-emitting element while the temperature of the red light-emitting element is held constant would also change the FCI.

To summarize the above experiment results, the FCI changes because the peak wavelength of the red light shifts toward longer wavelengths. The shift in peak wavelength is caused by an increase in the temperature of the red light-emitting element and by an increase in the current flowing through the red light-emitting element. Then, in conventional lighting equipment, given that the combination of the white light source and the red light source had been optimized under an assumption of lighting conditions in which the peak wavelength is not shifted toward the longer wavelengths, the shift in the peak wavelength toward the longer wavelengths produced a mismatch that lowered the FCI.

Through the above-described background, the inventors arrived at using a first red light source producing red light having a peak wavelength optimized for first lighting conditions in combination with a second red light source producing red light having a peak wavelength optimized for second lighting conditions in order to obtain a desired FCI after the shift in peak wavelength. Then, switching between the two red light sources in accordance with the lighting conditions successfully realized lighting equipment obtaining illumination light having a desired FCI under both the first lighting conditions and the second lighting conditions. That is, the aim of providing lighting equipment is provided that enables illumination light having a stable FCI to be obtained, without influence from the lighting conditions, is thus achieved.

<Lighting Equipment>

Lighting equipment, an illumination device, and a light-emitting module pertaining to one aspect of the present disclosure are described below, with reference to the accompanying drawings. The components given in the drawings are reduced in size and differ from reality.

Figure 4:
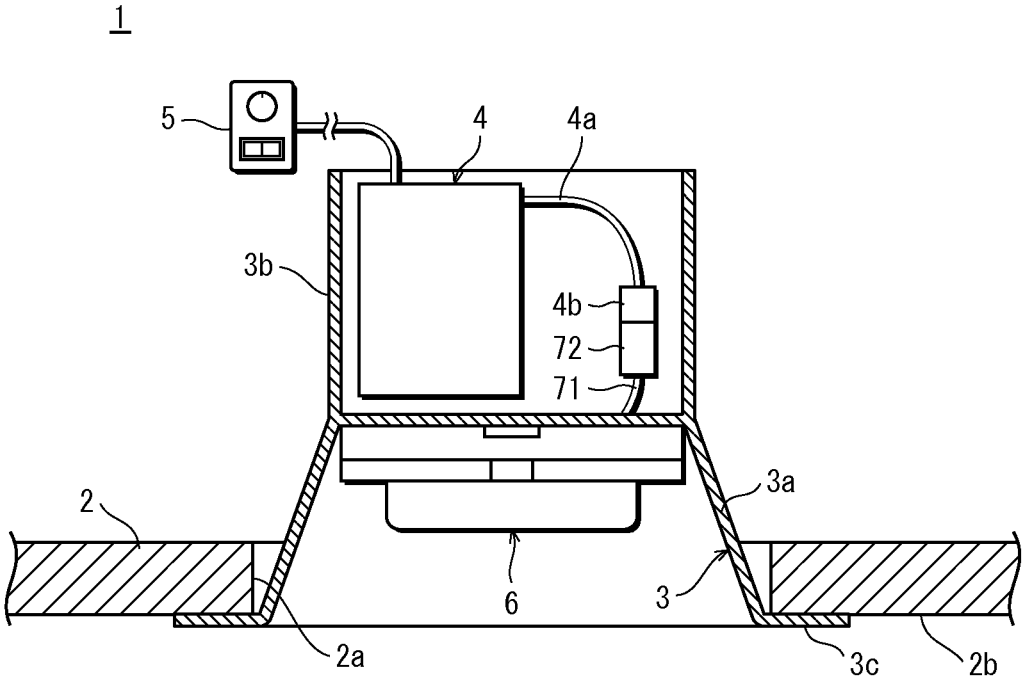
FIG. 4 is a cross-sectional diagram depicting lighting equipment pertaining to an aspect of the present disclosure.

FIG. 4 is a cross-sectional diagram depicting lighting equipment pertaining to an aspect of the present disclosure. As depicted in FIG. 4, lighting equipment 1 pertaining to the aspect of the present disclosure is, for example, a downlight affixed by mounting in a ceiling 2, and includes a fixture 3, a circuit unit 4, a dimming unit 5, and a lighting device 6.

The fixture 3 is, for example, made of metal, and includes a lamp housing 3*a*, a circuit housing 3*b*, and an outer flange 3*c*. The lamp housing 3*a* is, for example, a bottomed cylinder. The lighting device 6 is removably attached within the lamp housing 3*a*. The circuit housing 3*b*, for example, extends toward a bottom side of the lamp housing 3*a*, and houses the circuit unit 4 therein. The outer flange 3*c* is, for example, annular, and extends outward from an opening in the lamp housing 3*a*. The fixture 3 is affixed to the ceiling 2 by, for example, a (non-diagrammed) mounting screw filling a filling hole 2*a* where the lamp housing 3*a* and the circuit housing 3*b* pass through the ceiling 2 with the outer flange 3*c* being in contact with a periphery of the filling hole 2*a* at a lower face 2*b* of the ceiling 2.

The circuit unit 4 serves to light the lighting device 6, and includes a power supply line 4*a* that is electrically connected to the lighting device 6. A connector 4*b*, affixed to a front end of the power supply line 4*a*, is removably connected to lead lines 71 and a connector 72 of the lighting device 6.

The dimming unit 5 is used by a user to adjust the brightness of the illumination light from the lighting device 6. The dimming unit 5 is electrically connected to the circuit unit 4, and outputs a dimming signal to the circuit unit 4 upon receiving a user operation.

<Illumination Device>

Figure 5:
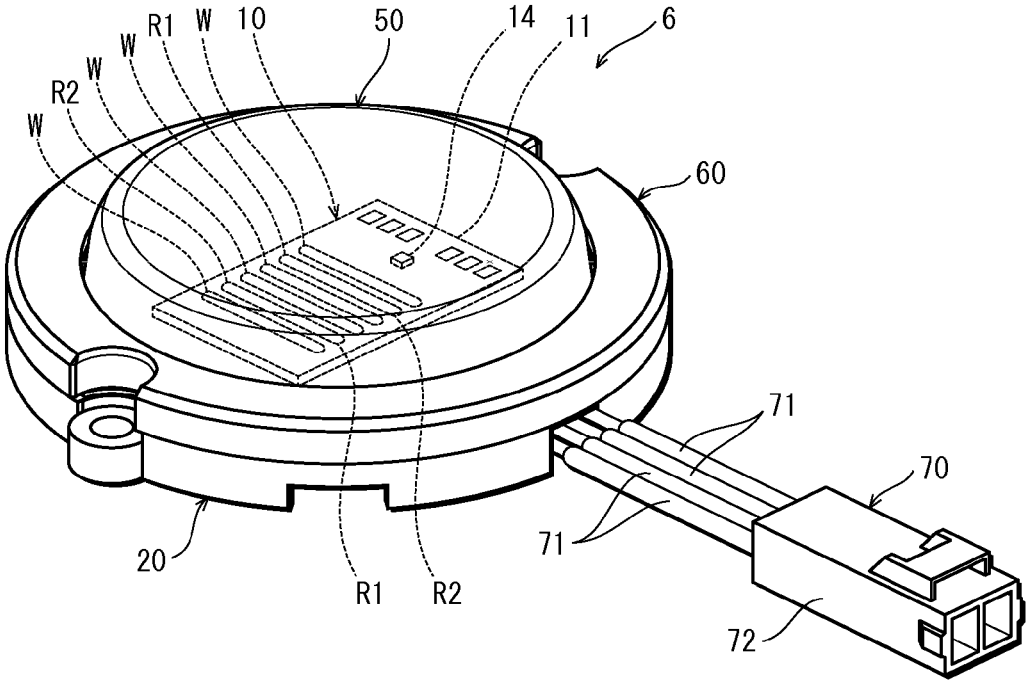
FIG. 5 is a perspective view diagram depicting an illumination device pertaining to the aspect of the present disclosure.
Figure 6:
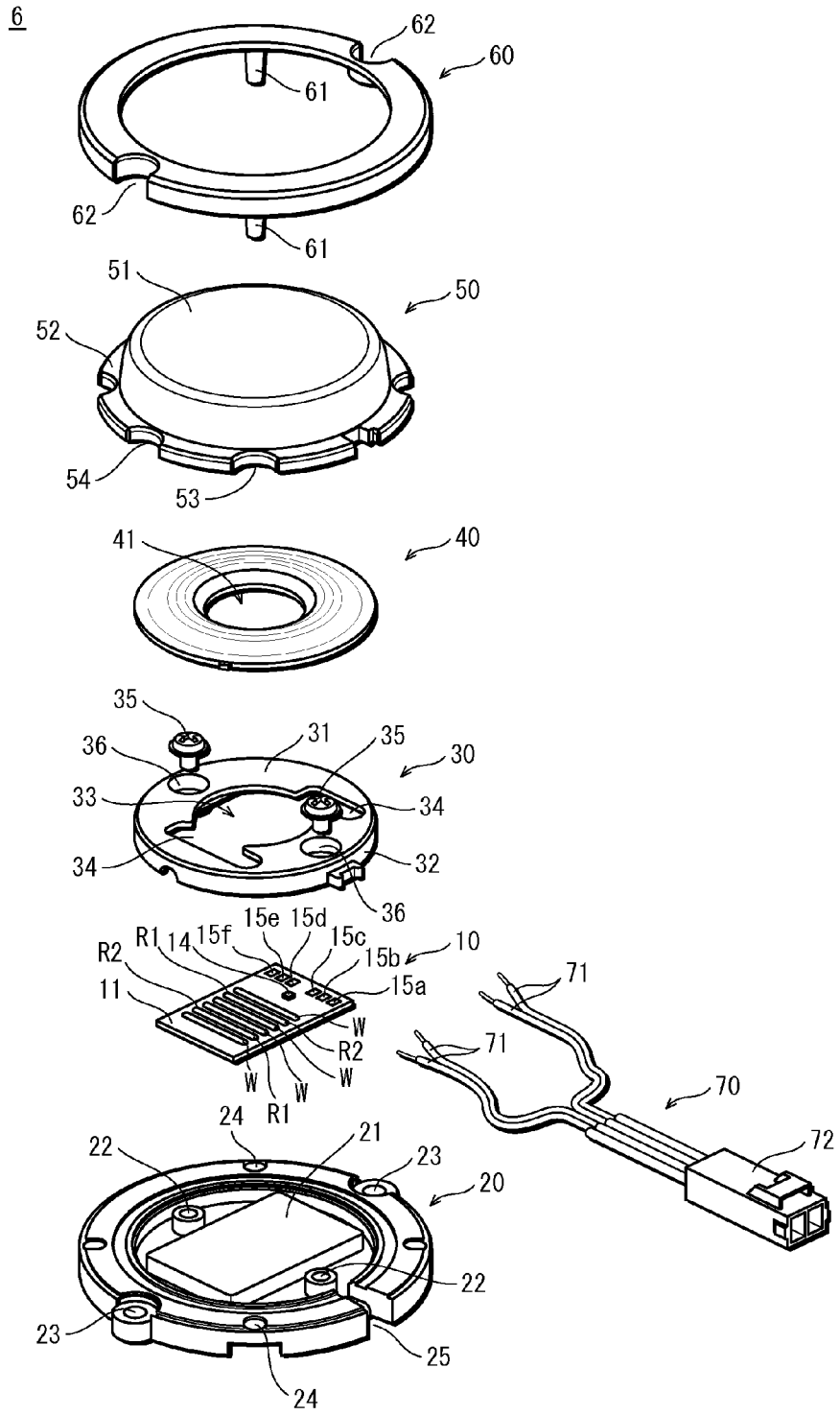
FIG. 6 is an exploded perspective view diagram depicting the illumination device pertaining to the aspect of the present disclosure.

FIG. 5 is a perspective view diagram depicting the illumination device pertaining to an aspect of the present disclosure. FIG. 6 is an exploded perspective view depicting the illumination device pertaining to the aspect of the present disclosure. As illustrated by FIGS. 5 and 6, the lighting device 6 is a lamp unit including, for example, a light-emitting module 10, a base 20, a holder 30, a decorative cover 40, a cover 50, a cover pressing member 60, a wiring member 70, and so on.

(Light-Emitting Module)

Figure 7A:
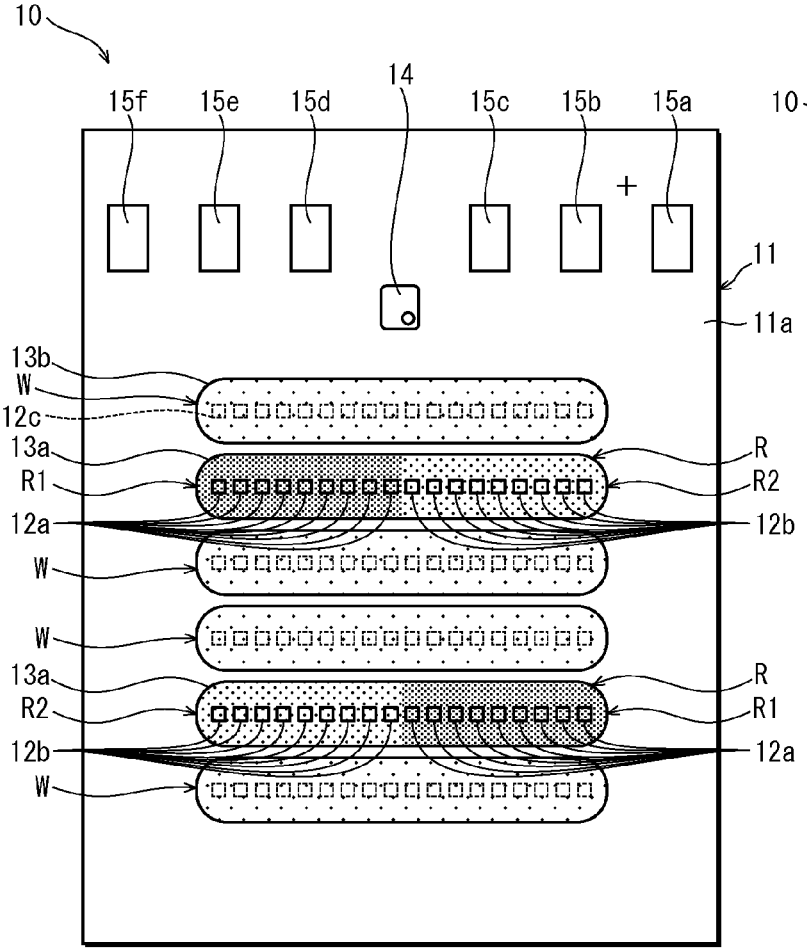
FIGS. 7A, 7B, and 7C depict a light-emitting module pertaining to the aspect of the present disclosure, FIG. 7A being a plan view, FIG. 7B being a right-side view, and FIG. 7C being a front view.
Figure 7B:
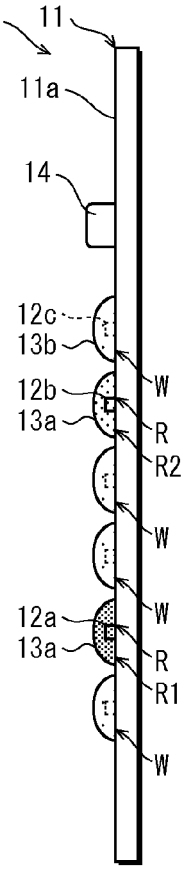
Figure 7C:
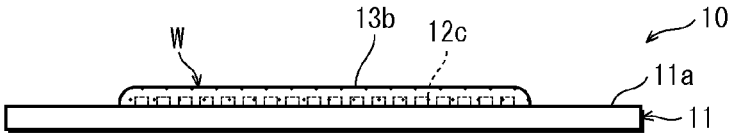
Figure 8:
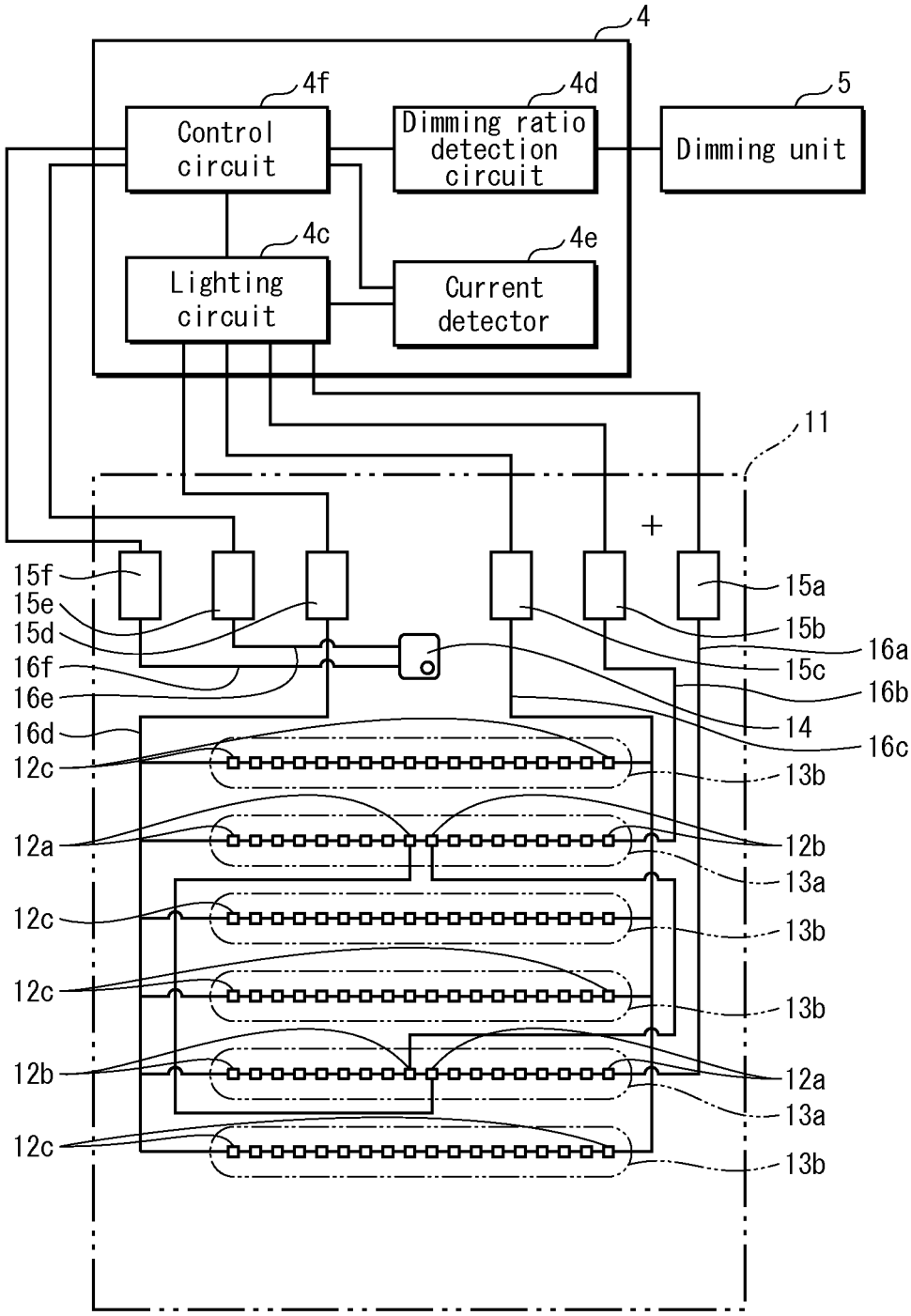
FIG. 8 is a wiring diagram describing connections between the light-emitting module and a circuit unit pertaining to the aspect of the present disclosure.

FIGS. 7A, 7B, and 7C depict the light-emitting module pertaining to the aspect of the present disclosure, FIG. 7A being a plan view, FIG. 7B being a right-side view, and FIG. 7C being a front view. FIG. 8 is a wiring diagram illustrating connections between the light-emitting module and the circuit unit pertaining to the aspect of the present disclosure. For ease of understanding of the arrangement of light sources R1, R2, and W, FIGS. 7A, 7B, and 7C depict the light sources R1, R2, and W with matching patterns for components of the same color and different patterns for components of different colors.

As depicted in FIGS. 7A, 7B, 7C, and 8, the light-emitting module 10 includes a substrate 11, light-emitting elements 12*a*, 12*b*, and 12*c*, sealer members 13*a* and 13*b*, a temperature detector 14, terminals 15*a* through 15*f*, and wiring 16*a* through 16*f*.

The substrate 11 is, for example, rectangular, having a two-layer structure combining an insulation layer made of a ceramic substrate, a heat-conducting resin, or similar, and a metallic layer made of an aluminum plate or similar. The light-emitting elements 12*a*, 12*b*, and 12*c* are mounted on a top face 11*a* of the substrate 11.

The light-emitting elements 12*a*, 12*b*, and 12*c* are, for example, LEDs mounted face up using Chip-on-Board (hereinafter, COB) technology on the upper surface 11*a* of the substrate 11. Here, the light-emitting elements pertaining to the present disclosure may be, for example, laser diodes (hereinafter, LD) or electroluminescence elements (hereinafter, EL elements). The light-emitting elements 12*a*, 12*b*, and 12*c* are provided in three types, namely a first red light-emitting element 12*a*, a second red light-emitting element 12*b*, and a white light-emitting element 12*c*.

The first red light-emitting element 12*a* is a red light-emitting element constituting the first red light source R1, emitting red light having a peak wavelength of no less than 625 nm and no more than 628 nm when, for example, lit with a current of 40 mA at a temperature of 25° C. Here, the first red light-emitting element 12*a* is not limited to the red light-emitting element producing red light having the above-described peak wavelength. The red light-emitting element 12*a* may also produce red light having a different peak wavelength. The red light produced by the first red light-emitting element 12*a* is termed first red light, below.

The second red light-emitting element 12*b* is a red light-emitting element constituting the second red light source R2, emitting red light having a peak wavelength of no less than 622 nm and no more than 625 nm when, for example, lit with a current of 40 mA at a temperature of 25° C. Here, the second red light-emitting element 12*b* is not limited to the red light-emitting element producing red light having the above-described peak wavelength. The red light-emitting element 12*b* may also produce red light having a different peak wavelength. However, the red light-emitting element 12*b* must emit red light having an emission peak that is closer to the short wavelength side than the first red light-emitting element 12*a* when lit under similar lighting conditions. The red light produced by the second red light-emitting element 12*b* is termed second red light, below.

In order to maintain a stable FCI, the peak wavelength of the second red light produced by the second red light source R2 under the second lighting conditions is beneficially shorter than the peak wavelength of the first red light produced by the first red light source R1 under the second lighting conditions by at least 5 nm, and more beneficially by at least 10 nm. Accordingly, when wavelength conversion is not performed by the sealer member 13*a* as in the present Embodiment, the peak wavelength of the second red light produced by the second red light-emitting element 12*b* under the second lighting conditions is beneficially shorter than the peak wavelength of the first red light produced by the first red light-emitting element 12*a* under the second lighting conditions by at least 5 nm, and more beneficially by at least 10 nm.

The white light-emitting element 12*c* is a blue light-emitting element constituting the white light source W, emitting blue light having a peak wavelength of, for example, no less than 450 nm and no more than 470 nm. The white light-emitting element 12*c* of the present disclosure is not limited to blue light-emitting element emitting blue light having a peak wavelength of no less than 450 nm and no more than 470 nm. A blue light-emitting element emitting blue light having a different wavelength, or a light-emitting element emitting ultraviolet light may also be used.

The light-emitting elements 12*a*, 12*b*, and 12*c* are, for example, arranged as six parallel rows, each row being an element row of 18 light-emitting element 12*a*, 12*b*, or 12*c* in a straight line. In terms of color, the arrangement includes a row of nine of the first red light-emitting element 12*a* and a row of nine of the second red light-emitting element 12*b* arranged as two out of every six element rows. Also, one of these two element rows is made up of nine consecutive first red light-emitting elements 12*a* followed by nine consecutive second red light-emitting elements 12*b*. The other one of the two element rows is made up of the first red light-emitting element 12*a* and the second red light-emitting element 12*b* arranged in the opposite order. In addition, the remaining four element rows of the aforementioned six element rows are each composed of 18 of the white light-emitting element 12*c*.

The sealer members 13*a* and 13*b* individually seal the light-emitting elements 12*a*, 12*b*, or 12*c* into the element rows. The sealer members 13*a* and 13*b* are, for example, elongated members having a cross-section, taken along a virtual plane intersecting the longitudinal direction, that is substantially semi-elliptical (see FIG. 7B). Also, both ends of the sealer members 13*a* and 13*b* in the longitudinal direction are rounded (substantially being four semi-spheres). As seen in a plan view, the ends in the longitudinal direction are shaped as semi-circles, as depicted in FIG. 7A. The shape of the sealer members 13*a* and 13*b* is arbitrary and non-limiting, and may also be rectangular, for example. Also, the sealer members 13*a* and 13*b* may be connected by connecting members made of a translucent material, so as to be continuous.

The sealer members 13*a* and 13*b* are, for example, made of a translucent material. The translucent material may be, for example, a silicone resin, an epoxy resin, a fluorine resin, a silicone epoxy hybrid resin, a urea resin, and so on. The sealer members 13*a* and 13*b* are provided as two types, with the first sealer member 13*a* sealing the first red light-emitting element 12*a* and the second red light-emitting element 12*b*, and the second sealer member 13*b* sealing the white light-emitting element 12*c*. The first sealer member 13*a* does not function as a wavelength converter member given that no wavelength converter material is combined with the translucent material. In contrast, the second sealer member 13*b* functions as a wavelength converter member, given that a wavelength converter material is combined with the translucent material therein. The wavelength converter material may be, for example, phosphor particles. A dispersion material may be combined with the translucent material of the first sealer member 13*a*.

The first red light source R1 is configured from nine of the first red light-emitting element 12*a* and the first sealer member 13*a* sealing the nine first red light-emitting elements 12*a*. In the first red light source R1, the red light from the first red light-emitting elements 12*a* exits to outside the first sealer member 13*a* without wavelength conversion through the first sealer member 13*a*. Furthermore, given that the first sealer member 13*a* is colorless and transparent, the first red light source R1 produces red light having a peak wavelength of no less than 625 nm and no more than 628 nm, which is identical to the first red light emitted by the first red light-emitting elements 12*a*.

The second red light source R2 is configured from nine of the first second light-emitting element 12*b* and the first sealer member 13*a* sealing the nine second red light-emitting elements 12*b*. In the second red light source R2, the red light from the second red light-emitting elements 12*b* also exits to outside the first sealer member 13*a* without wavelength conversion through the first sealer member 13*a*. Thus, the second red light source R2 produces red light having a peak wavelength of no less than 622 nm and no more than 625 nm, which is identical to the second red light emitted by the second red light-emitting elements 12*b*.

The first red light source R1 and the second red light source R2 are formed as a pair linking one of each light source into a red light source block R combining the first red light source R1 and the second red light source R2. The red light source block R has an elongated shape dependent on the shape of the first sealer member 13*a*.

The white light source W includes 18 of the white light-emitting element 12*c* and the second sealer member 13*b*, which performs wavelength conversion on a portion of the light from the white light-emitting elements 12*c*. Thus, the white light source W produces white light obtained by combining light from the white light-emitting element 12*c* that is converted by the second sealer member 13*b* and light from the white light-emitting element 12*c* that is not converted by the second sealer member 13*b*. The second sealer member 13*b* performs, for example, wavelength conversion of the blue light from the white light-emitting element 12*c* into light having a peak wavelength of no less than 535 nm and no more than 555 nm, as well as a full width at half maximum of no less than 50 nm and no more than 70 nm. The white light source W has an elongated shape that is dependent on the shape of the second sealer member 13*b* and identical to the shape of the red light source block R.

The quantity of the light-emitting elements 12*a*, 12*b*, or 12*c* sealed by each of the sealer members 13*a* and 13*b* is arbitrary. Also, the respective shapes of the sealer members 13*a* and 13*b* and of the light sources R1, R2 and W is arbitrary and not limited to being elongated. For example, the block shapes of Variations 2 and 3, the annular shape of Variation 4, and the dot shape of Variation 5 are all applicable. Further, the wavelength converter material combined with the transparent material of the second sealer member 13*b* is not limited to a wavelength converter material performing wavelength conversion into light having a peak wavelength of no less than 535 nm and no more than 555 nm and a full width at half maximum of no less than 50 nm and no more than 70 nm. Any wavelength converter material obtaining white light by combination with the white light-emitting element 12*c* may apply.

Two of the red light source block R and four of the white light source W are arranged in parallel with equal spacing therebetween so that both edges are uniform. Also, in order to prevent discoloration of the light-emitting module 10, no neighboring pairs of the red light source block R are arranged in the row direction. Specifically, the parallel arrangement of components is white light source W, red light source block R, white light source W, white light source W, red light source block R, white light source W, and so on, in the stated order.

The temperature detector 14 is, for example, a temperature sensing integrated circuit (hereinafter, IC) provided on the upper surface 11*a* of the substrate 11, and detects the temperature of the first red light-emitting element 12*a*. Temperature information obtained as a detection result is output to a control circuit 4*f* of the circuit unit 4. The specific detection method used to detect the temperature of the first red light-emitting element 12*a* may involve directly detecting the temperature of the first red light-emitting element 12*a*, or may involve indirect detection based on the temperature of the substrate 11, the temperature of the second red light-emitting element 12*b*, the temperature of a member disposed in the periphery of the first red light-emitting element 12*b*, the atmospheric temperature around the light-emitting elements 12*a*, 12*b*, and 12*c*, or similar. The temperature detector pertaining to the present disclosure is not limited to being a temperature sensor IC, but may also be any component capable of directly or indirectly detecting the temperature of the first red light-emitting element 12*a*. For example, when a later-described lighting circuit is incorporated with the substrate of the light-emitting module, a thermistor may be inserted into the lighting circuit and the thermistor may serve as the temperature detector.

The terminals 15*a* through 15*f* are configured from a conductor pattern formed on the substrate 11. Terminal 15*a* and terminal 15*d* serve to supply power to the first red light-emitting element 12*a*. Terminal 15*b* and terminal 15*d* serve to supply power to the second red light-emitting element 12*b*. Terminal 15*c* and terminal 15*d* serve to supply power to the white light-emitting element 12*c*. Terminal 15*e* and terminal 15*f* serve as connection terminals electrically connecting the temperature detector 14 and the circuit unit 4. As depicted in FIGS. 7A, 7B, and 7C, the terminals 15*a* through 15*f* are formed at the periphery of the upper surface 11*a* of the substrate 11.

The wiring 16*a* through 16*f* is also configured from the conductor pattern formed on the substrate 11. Wiring 16*a* electrically connects the first red light-emitting element 12*a* and terminal 15*a*, wiring 16*b* electrically connects the second red light-emitting element 12*b* and terminal 15*b*, and wiring 16*c* electrically connects the white light-emitting element 12*c* and terminal 15*c*. Also, wiring 16*d* electrically connects the respective light-emitting elements 12*a*, 12*b*, and 12*c* and terminal 15*d*. Wiring 16*e* and 16*f* electrically connects the temperature detector 14 to respective terminals 15*e* and 15*f*.

The first red light-emitting element 12*a* is provided as nine of the first red light-emitting element 12*a* belonging to one red light source block R and nine of the first red light-emitting element 12*a* belonging to another red light source block R, for a total of 18 of the first red light-emitting element 12*a*. The second red light-emitting element 12*b* is similarly provided as nine of the second red light-emitting element 12*b* belonging to one red light source block R and nine of the second red light-emitting element 12*b* belonging to another red light source block R, for a total of 18 of the second red light-emitting element 12*b*. The white light-emitting element 12*c* is provided as four rows of 18 elements in a series-parallel connection. Specifically, each white light source W includes 18 of the white light-emitting element 12*c* connected in series, four element groups from each of four of the white light source W being connected in parallel.

The light-emitting elements 12*a*, 12*b*, and 12*c* in the light sources R1, R2, W undergo individual lighting control.

The light-emitting module described above is able to produce illumination light having a stable FCI unaffected by the lighting conditions through red light source switching control performed by the lighting circuit as described below.

(Base)

Returning to FIG. 6, the base 20 is, for example, a disc made of die-cast aluminum, having a mounting part 21 at the center of an upper surface. The light-emitting module 10 is mounted on the mounting part 21. The base 20 also has screw holes 22 provided in the upper surface of the base 20 on either side of the mounting part 21. Assembly screws 35 screw into the screw holes 22 to fix the holder 30. The periphery of the base 20 is provided with through-holes 23, boss holes 24, and a notch 25. The respective roles of the through-holes 23, the boss holes 24, and the notch 25 are described later.

(Holder)

The holder 30 is, for example, a bottomed cylinder, and includes a holder plate 31 that is discoid and a peripheral wall 32 that is tubular and extends from the periphery of the holder plate toward the base 20. The light-emitting module 10 is fixed to the base 20 by the holder plate 31 pressing light-emitting module 10 against the mounting part 21.

A window 33 for exposing the light sources R1, R2, and W of the light-emitting module 10 is provided at the center of the holder plate 31. Also, an opening 34 is provided at the periphery of the holder plate 31 in order to prevent lead lines 71 connected to the light-emitting module 10 from interfering with the holder 30, and is formed continuously with the window 33. Furthermore, through-holes 36 are provided are provided at the periphery of the holder plate 31 of the holder 30 at positions corresponding to the screw holes 22 of the base 20 for the assembly screws 35 to pass therethrough.

When affixing the holder 30 onto the base 20, the substrate 11 of the light-emitting module 10 is first held sandwiched between the base 20 and the holder 30, with the light sources R1, R2, and W being exposed through the window 33 of the holder 30. Next, the assembly screws 35 are passed through the through-holes 36 intended therefor from above the holder plate 31 of the holder 30. The holder 30 is affixed to the base 20 by the assembly screws 35 screwing into the screw holes 22 of the base 20.

(Decorative Cover)

The decorative cover 40 is, for example, an annular non-translucent member composed from opaque white resin or similar, is disposed between the holder 30 and the cover 50, and covers the lead lines 71, the assembly screws 35, and other components exposed by the opening 34 from view. A window 41 is formed in the center of the decorative cover 40 to expose the light sources R1, R2, and W.

(Cover)

The cover 50 is, for example, formed from a translucent material such as a silicone resin, an acrylic resin, or glass. Light emitted by the light sources R1, R2, and W passes through the cover 50 and exits the lighting device 6. The cover 50 includes a main body 51 serving as a dome-shaped lens covering the light sources R1, R2, and W, and an outer flange 52 extending outward from the periphery of the main body 51. The outer flange 52 is fixed to the base 20.

(Cover Pressing Member)

The cover pressing member 60 is, for example, formed of a non-translucent material such as aluminum or a similar metal, or an opaque white resin, in an annular shape so as to avoid blocking the light emitted through the main body 51 of the cover 50. The outer flange 52 of the cover 50 is held fixed between the cover pressing member 60 and the base 20.

Boss parts 61 are provided on the lower surface of the cover pressing member 60, being columnar and protruding toward the base 20. Semi-circular notches 53 are formed in the outer flange 52 of the cover 50 at positions corresponding to the boss parts 61, in order to avoid the boss parts 61. Furthermore, boss holes 24 for allowing the boss parts 61 to pass are provided in the periphery of the base 20 at position corresponding to the boss parts 61. When fixing the cover pressing member 60 to the base 20, the boss parts 61 of the cover pressing member 60 are passed through the boss holes 24 of the base 20. A front end portion of each of the boss parts 61 is exposed to laser light from below the base 20 and undergoes plastic deformation so that the respective end portions do not fall from the boss holes 24. Thus, the cover pressing member 60 is fixed to the base 20.

Notches 54 and 62 are respectively formed in the outer flange 52 of the cover 50 and the periphery of the cover pressing member 60. The notches 54 and 62 are semi-circular and are located at positions corresponding to the through-holes 23 in the base 20 so that (non-diagrammed) fixing screws passing through the through-holes 23 do not come into contact with the cover pressing member 60 and the cover 50.

(Wiring Member)

The wiring member 70 includes a pair of lead lines 71 electrically connected to the light-emitting module 10. The connector 72 is affixed to an end of the lead lines 71 opposite the side thereof connected to the light-emitting module 10. The lead lines 71 of the wiring member 70, being connected to the light-emitting module 10, are guided out of the lighting device 6 via the notch 25 of the base 20.

<Lighting Control>

(Circuit Configuration)

As depicted in FIG. 8, the circuit unit 4 is a lighting circuit unifying a lighting circuit 4*c*, a dimming ratio detection circuit 4*d*, a current detector 4*e*, and a control circuit 4*f*. The circuit unit 4 is electrically connected to a (non-diagrammed) commercial alternating current power source and supplies current input from the commercial alternating current power source to the light-emitting module 10. The circuit unit 4 performs individual lighting control for each color of the light sources R1, R2, and W, i.e., for the first red light source R1, the second red light source R2, and for the white light source W.

The lighting circuit 4*c* is configured from a circuit that includes a (non-diagrammed) AC/DC converter, and supplies power individually to the first red light-emitting element 12*a*, the second red light-emitting element 12*b*, and the white light-emitting element 12*c*. Specifically, the lighting circuit 4*c* converts the alternating current voltage from the commercial alternating current power source into a direct current voltage appropriate for the first red light-emitting element 12*a*, a direct current voltage appropriate for the second red light-emitting element 12*b*, and a direct current voltage appropriate for the white light-emitting element 12*c*. The lighting circuit 4*c* then applies the direct current voltage appropriate to each light-emitting element 12*a*, 12*b*, or 12*c* to the respective light-emitting elements 12*a*, 12*b*, and 12*c* as sequential voltage, in accordance with an instruction from the control circuit 4*f*. The AC/DC converter may be, for example, a diode bridge or similar.

The dimming ratio detection circuit 4*d* acquires a dimming signal from the dimming unit 5. The dimming unit 5 outputs the dimming signal to the dimming ratio detection circuit 4*d* upon receiving a user instruction or similar. The dimming signal includes dimming ratio information. The dimming ratio is an optical flux ratio relative to the full illumination (100% illumination) of the first red light-emitting element 12*a*, the second red light-emitting element 12*b*, and the white light-emitting element 12*c*. The dimming ratio information is output from the dimming ratio detection circuit 4*d* to the control circuit 4*f*.

The current detector 4*e* is, for example, a current detecting resistor inserted serially onto the current circuit leading from the lighting circuit 4*c* to the first red light-emitting element 12*a*, and detects the current flowing to the first red light-emitting element 12*a*. The current detector 4*e* then outputs current information obtained as a detection result to the control circuit 4*f*. The method of detecting the current flowing in the first red light-emitting element 12*a* used by the current detector 4*e* is not limited to the above.

The control circuit 4*f* includes a microprocessor and memory. The control circuit 4*f* controls the brightness of the first red light-emitting element 12*a*, the second red light-emitting element 12*b*, and the white light-emitting element 12*c* by performing dimming control thereon using the microprocessor, in accordance with the dimming ratio input from the dimming ratio detection circuit 4*d*. Specifically, the control circuit 4*f* individually sets the duty ratio of the first red light-emitting element 12*a*, the second red light-emitting element 12*b*, and the white light-emitting element 12*c* in accordance with the dimming ratio, and performs pulse-width modification (hereinafter, PWM) control of the first red light-emitting element 12*a*. the second red light-emitting element 12*b* and the white light-emitting element 12*c*. In addition, the control circuit 4*f* performs the following red light source switching control in accordance with the temperature information acquired from the temperature detector 14 and the current information acquired from the current detector 4*e*.

(Red Light Source Switching Control)

Figure 9:
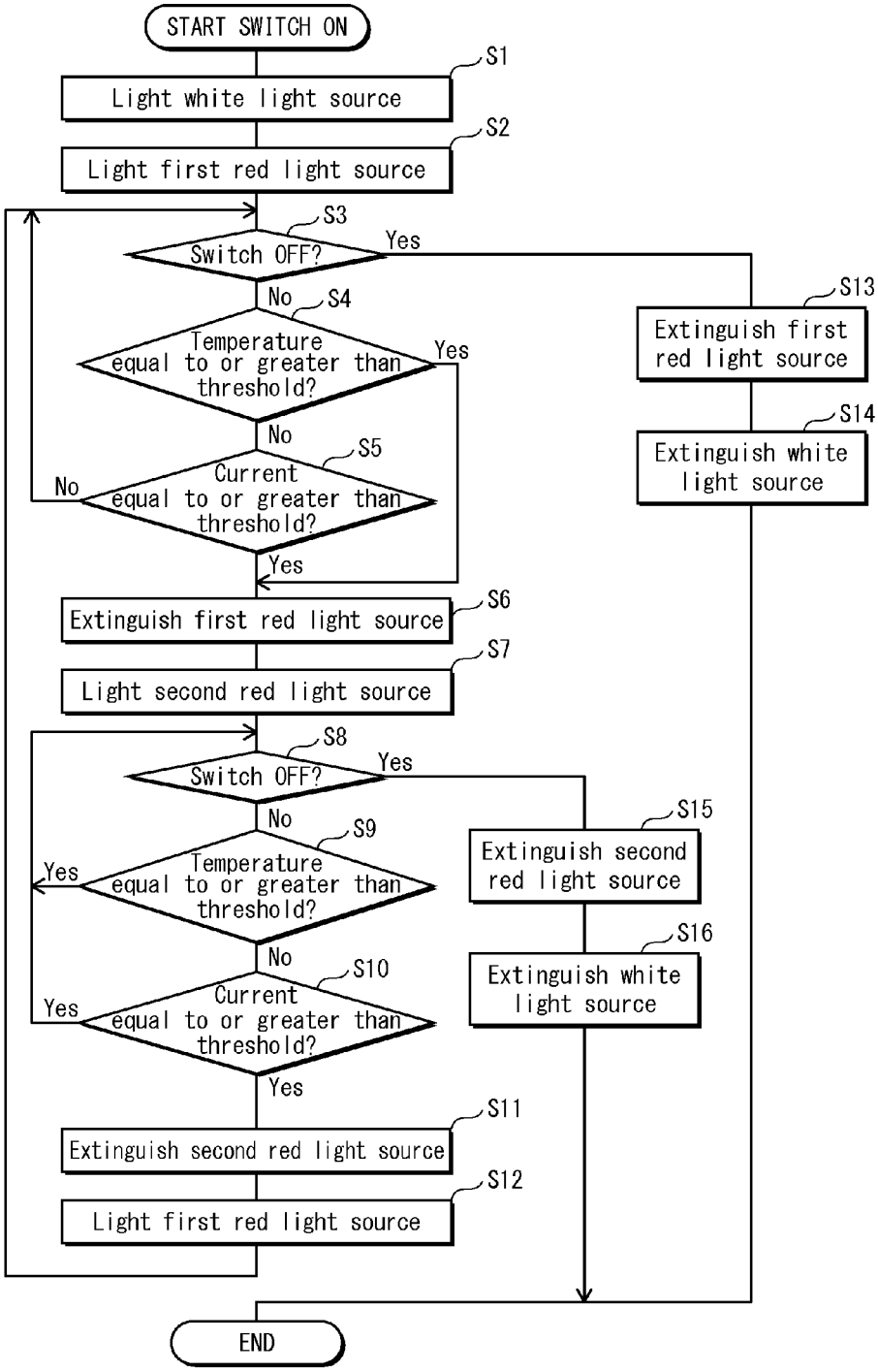
FIG. 9 is a flowchart describing red light source switching control operations pertaining to the aspect of the present disclosure.

FIG. 9 is a flowchart describing the operations of the red light source switching control. As depicted in FIG. 9, the red light source switching control pertaining to the present Embodiment begins when an ON-OFF switch of the lighting equipment 1 is switched ON. At this time, the lighting circuit 4*c* begins supplying electric power to the white light-emitting element 12*c*, lighting the white light source W1 (step S1), and begins supplying electric power to the first red light-emitting element 12*a*, lighting the first red light source R1 (step S2). The electric power is most beneficially supplied simultaneously to the white light source W and the first red light source R1. Otherwise, supplying the white light source W first is beneficial, though the first red light source R1 may also be supplied first.

Once the white light source W and the first red light source R1 have been lit, the control circuit 4*f* performs monitoring until the switch is switched OFF (YES in step S3). The control circuit 4*f* monitors whether the temperature of the first red light source R1 is equal to or greater than a threshold (step S4) and whether or not the current flowing in the first red light source R1 is equal to or greater than a threshold (step S5).

When either one of the temperature and the current is equal to or greater than the threshold (YES in step S4 or YES in step S5), the lighting circuit 4*c* extinguishes the first red light source R1 by stopping the supply of electric power to the first red light-emitting element 12*a* (step S6) and lights the second red light source R2 by beginning to supply electric power to the second red light-emitting element 12*b* (step S7). That is, the red light source is switched from the first red light source R1 to the second red light source R2. Beneficially, the lighting circuit 4*c* simultaneously stops supplying the electric power to the first red light-emitting element 12*a* and begins supplying the electric power to the second red light-emitting element 12*b*. However, the supply of electric power to the second red light-emitting element 12*b* may also begin first, and the supply of the electric power to the first red light-emitting element 12*b* may end first.

Once the red light source has been switched, the control circuit 4*f* performs monitoring until the switch is switched OFF (YES in step S8). The control circuit 4*f* monitors whether the temperature of the second red light source R2 is equal to or greater than the threshold (step S9) and whether or not the current flowing in the second red light source R2 is equal to or greater than the threshold (step S10).

When either one of the temperature and the current is no longer equal to or greater than the threshold (NO in step S9 and NO in step S10), the lighting circuit 4*c* extinguishes the second red light source R2 by stopping the supply of electric power to the second red light-emitting element 12*b* (step S11) and lights the first red light source R1 by beginning to supply the electric power to the first light-emitting element 12*a* (step S12). That is, the red light source is switched from the second red light source R2 to the first red light source R1. Beneficially, the lighting circuit 4*c* simultaneously stops supplying the electric power to the second red light-emitting element 12*b* and begins supplying the electric power to the first red light-emitting element 12*a*. However, the supply of electric power to the first red light-emitting element 12*a* may also begin first, and the supply of the electric power to the second red light-emitting element 12*b* may end first.

Once the red light source has been switched, the process returns to step S3, in which the control circuit 4*f* performs monitoring until the switch is switched OFF (YES in step S3). The control circuit 4*f* monitors whether the temperature of the first red light source R1 is equal to or greater than the threshold (step S4) and whether or not the current flowing in the first red light source R1 is equal to or greater than the threshold (step S5).

In step S3, when the switch is switched OFF (YES in step S3), the first red light source R1 is extinguished by stopping the power supply to the first red light source R1 (step S13) and the white light source W is extinguished by stopping the power supply to the white light-emitting element 12*c* (step S14). The lighting equipment 1 is thus fully extinguished.

In step S8, when the switch is switched OFF (YES in step S8), the second red light source R2 is extinguished by stopping the power supply to the second red light source R2 (step S15) and the white light source W is extinguished by stopping the power supply to the white light-emitting element 12*c* (step S16). The lighting equipment 1 is thus fully extinguished.

Accordingly, the lighting equipment 1 has at least two lighting states. In the first state, the first red light source R1 is lit while the second red light source R2 is not lit. Control for this state is performed under the first lighting conditions. In the second state, the second red light source R2 is lit while the first red light source R1 is not lit. Control for this state is performed under the second lighting conditions.

The first lighting conditions are conditions in which the first red light source R1 produces red light having a first peak wavelength, or in other words, where the peak wavelength of the first red light source R1 is a desired peak wavelength unshifted toward longer wavelengths beyond a tolerance range. In the present Embodiment, the first red light source R1 is lit at a first temperature with a first current under the first lighting conditions. Also, the lighting conditions under which the red light having the first peak wavelength is produced are determinable in advance by investigating the optical properties of the first red light-emitting element 12*a*.

The second lighting conditions are conditions in which the first red light source R1 produces red light having a second peak wavelength that is shifted closer toward longer wavelengths than the first peak wavelength, or in other words, where the peak wavelength of the first red light source R1 is a peak wavelength that is shifted toward longer wavelengths beyond the tolerance range. In the present Embodiment, the second lighting conditions are conditions in which the first red light source R1 is lit at a second temperature that is higher than the first temperature, where the first red light source R1 is lit with a second current that is greater than the first current, or both. Also, the lighting conditions under which the red light having the second peak wavelength is produced are determinable in advance by investigating the optical properties of the first red light-emitting element 12*a*.

Under the first lighting conditions, the first red light source R1 is lit while the second red light source R2 is not lit. Also, under the second lighting conditions, the second red light source R2 is lit instead of the first red light source R1. That is, the state changes from the first red light-emitting element 12*a* being lit while the second red light-emitting element 12*b* is not lit, to the second red light-emitting element 12*b* being lit while the first red light-emitting element 12*a* is not lit.

Under the first lighting conditions, the peak wavelength of the first red light from the first red light source R1 is not shifted toward the longer wavelengths beyond the tolerance range. That is, the peak wavelength of the red light from the first red light source R1 does not reach the second peak wavelength. In these circumstances, the first red light source R1 is beneficially lit, while the second red light source R2 is unnecessary. The first red light produced by the first red light source R1 has the desired peak wavelength, which is the first peak wavelength, under the first lighting conditions. Thus, the desired FCI is achieved.

Conversely, under the second lighting conditions, the peak wavelength of the red light from the first red light source R1 is shifted toward longer wavelengths and reaches the second peak wavelength. As such, the lit red light source is switched from the first red light source R1 to the second red light source R2. The second red light produced by the second red light source R2 has a desired peak wavelength under the second lighting conditions (in the present Embodiment, this peak wavelength is identical to the first peak wavelength of the first red light from the first red light source R1). As such, the desired FCI is maintainable under the second lighting conditions, as well.

Figure 10:
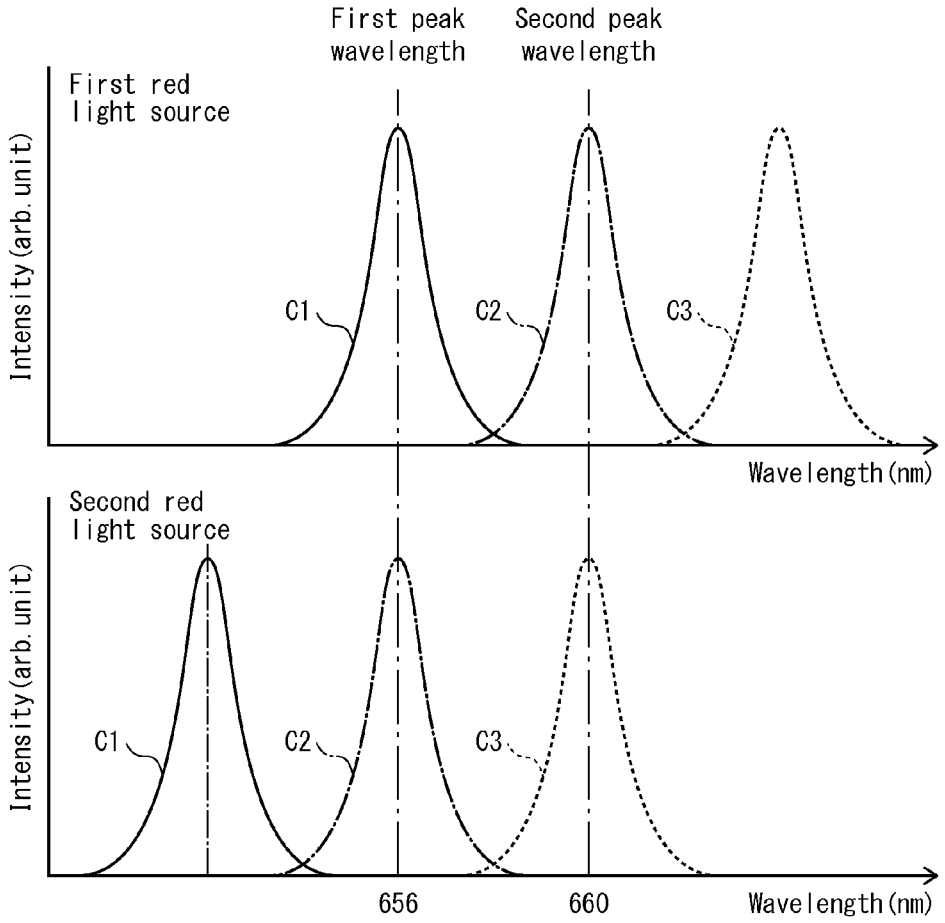
FIG. 10 describes the spectral properties of the first and second red light sources pertaining to the aspect of the disclosure.

FIG. 10 describes the spectral properties of the first and second red light sources pertaining to the aspect of the disclosure. As depicted in FIG. 10, the first red light from the first red light source R1 has the first peak wavelength (656 nm in FIG. 10), which is the desired peak wavelength under the first lighting conditions C1. The first red light having the first peak wavelength is combined with the white light produced by the white light source W to obtain the desired FCI. Conversely, the second red light from the second red light R2 has a peak wavelength closer to short wavelengths than the first peak wavelength. Combining the second red light having the second peak wavelength with the white light produced by the white light source W does not result in the desired FCI.

Next, when the temperature of the first red light-emitting element 12*a* undergoes an increase due to ongoing lighting of the light-emitting module 10, for example, or when the current flowing through the first red light-emitting element 12*a* is increased in order to raise the brightness of the light-emitting module 10, for example, then the peak wavelength of the red light from the first red light source R1 is shifted toward longer wavelengths. The second lighting conditions C2 occur once the second peak wavelength (660 nm in FIG. 10) is reached.

Under the second lighting conditions C2, the first red light from the first red light source R1 has the second peak wavelength, which is shifted toward longer wavelengths relative to the first peak wavelength. Combining the first red light having the second peak wavelength with the white light produced by the white light source W does not result in the desired FCI. Under the second lighting conditions C2, the second red light from the second red light source R2 has the desired peak wavelength, which is shifted toward longer wavelengths. The second red light having the desired peak wavelength is combined with the white light produced by the white light source W to obtain the desired FCI.

Figure 11:
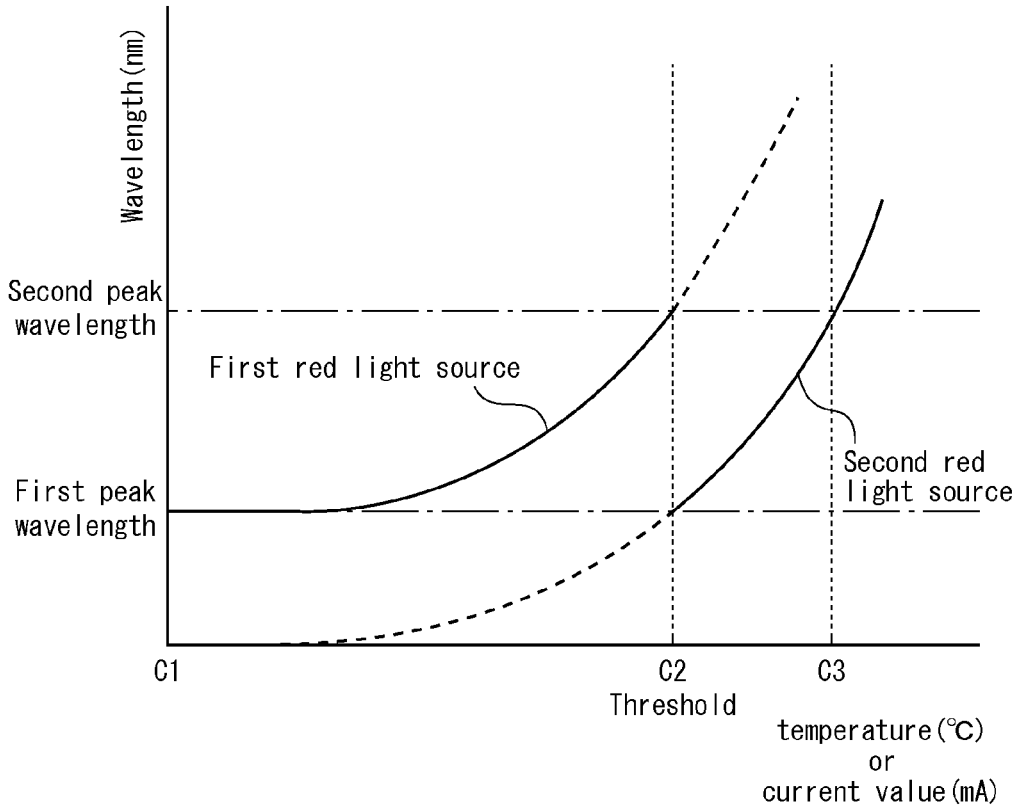
FIG. 11 describes the timing for switching in the red light source switching control pertaining to the aspect of the disclosure.

FIG. 11 describes the timing for switching in the red light source switching control pertaining to the aspect of the disclosure. As depicted in FIG. 11, the first red light source R1 is lit until the transition from the first lighting conditions C1 to the second lighting conditions C2. In other words, the first red light source R1 is lit until the peak wavelength of the first red light becomes the second peak wavelength (depicted as a solid line). However, the first red light source R1 is not lit once the second lighting conditions C2 come into effect, or in other words, once the peak wavelength of the first red light becomes the second peak wavelength (depicted as a dashed line). Conversely, the second red light source R2 is not lit during the transition from the first lighting conditions C1 to the second lighting conditions C2 (depicted as a dashed line) but is lit once the second lighting conditions C2 are in effect (depicted as a solid line).

In the present Embodiment, the threshold is set using the second temperature, at which the second lighting conditions C2 are reached, and using the second current, at which the second lighting conditions are also reached. For example, when the first temperature is 25° C. and the second temperature is 70° C., then for example the switch of the red light source from the first red light source R1 to the second red light source R2 occurs when the temperature reaches 70° C. Also, for example, when the first current is 25 mA and the second current is 60 mA, then for example the switch of the red light source from the first red light source R1 to the second red light source R2 occurs when the current reaches 60 mA.

Returning to FIG. 10, when the temperature of the first red light-emitting element 12*a* further increases, or when the current flowing in the first red light-emitting element 12*a* further increases, then the peak wavelength of not only the first red light source R1 but also the peak wavelength of the second red light source R2 is shifted toward longer wavelengths beyond the tolerance range. Accordingly, third lighting conditions C3 are reached, in which the peak wavelength of the red light from the second red light source R2 is no longer the desired peak wavelength. In the present Embodiment, the first red light source R1 remains unlit while the second red light source R2 remains lit, in order to maintain the state of the second lighting conditions through the third lighting conditions.

[Variations]

Variations on the lighting equipment, the illumination device, and the light emitting module of the present disclosure are described below.

(Red Light Source Switching Control)

In the above-described Embodiment, the switching of the red light source is performed according to the temperature of the first red light source R1 and according to the current flowing in the first red light source R1. However, the switching of the red light source may also be performed according to the temperature of the first red light source R1, only. In such a case, the first red light source is lit at the first temperature under the first lighting conditions, and is lit at the second temperature, which is higher than the first temperature, under the second lighting conditions. Also, steps S5 and S10 are omitted from the red light source switching control indicated in FIG. 9. Specifically, in step S4, when the temperature of the first red light source R1 is equal to or greater than the threshold (YES in step S4), the process advances to step S6. When the temperature of the first red light source R1 is not equal to or greater than the threshold (NO in step S4), the process returns to step S3. Also, in step S9, when the temperature of the first red light source R1 is not equal to or greater than the threshold (NO in step S9), the process advances to step S11. When the temperature of the first red light source R1 is equal to or greater than the threshold (YES in step S9), the process returns to step S8.

The switching of the red light source may also be performed in accordance with the current flowing in the first red light source R1, only. In such a case, the first red light source R1 is lit with the first current under the first lighting conditions, and is lit with the second current, which is greater than the first current, under the second lighting conditions. Also, steps S4 and S9 are omitted from the red light source switching control indicated in FIG. 9. Specifically, when the result of step S3 is NO, the process advances to step S5, and when the result of step S8 is NO, the process advances to step S10.

Also, in the above-described Embodiment, the temperature threshold is set to the second temperature, i.e., the temperature at which the second lighting conditions are reached. However, the temperature threshold may also be set to a temperature between the temperature of the first lighting conditions and the temperature of the second lighting conditions (i.e., a temperature that is higher than the first temperature and lower than the second temperature). Likewise, for the current, the current threshold is set to the second current, i.e., the current at which the second lighting conditions are reached. However, the current threshold may also be set to a current between the current of the first lighting conditions and the current of the second lighting conditions (i.e., a current that is greater than the first current and smaller than the second current).

Figure 12:
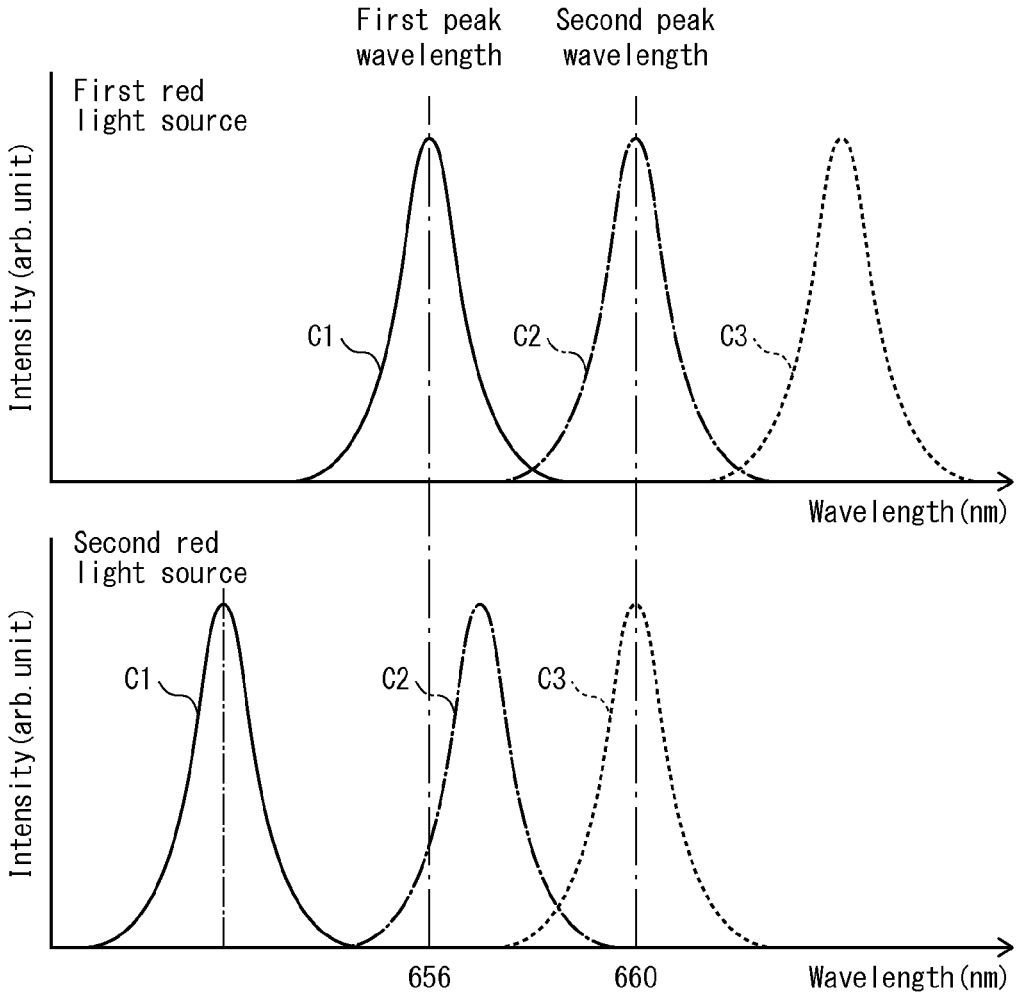
FIG. 12 describes the spectral properties of the first and second red light sources pertaining to a variation of the disclosure.
Figure 13:
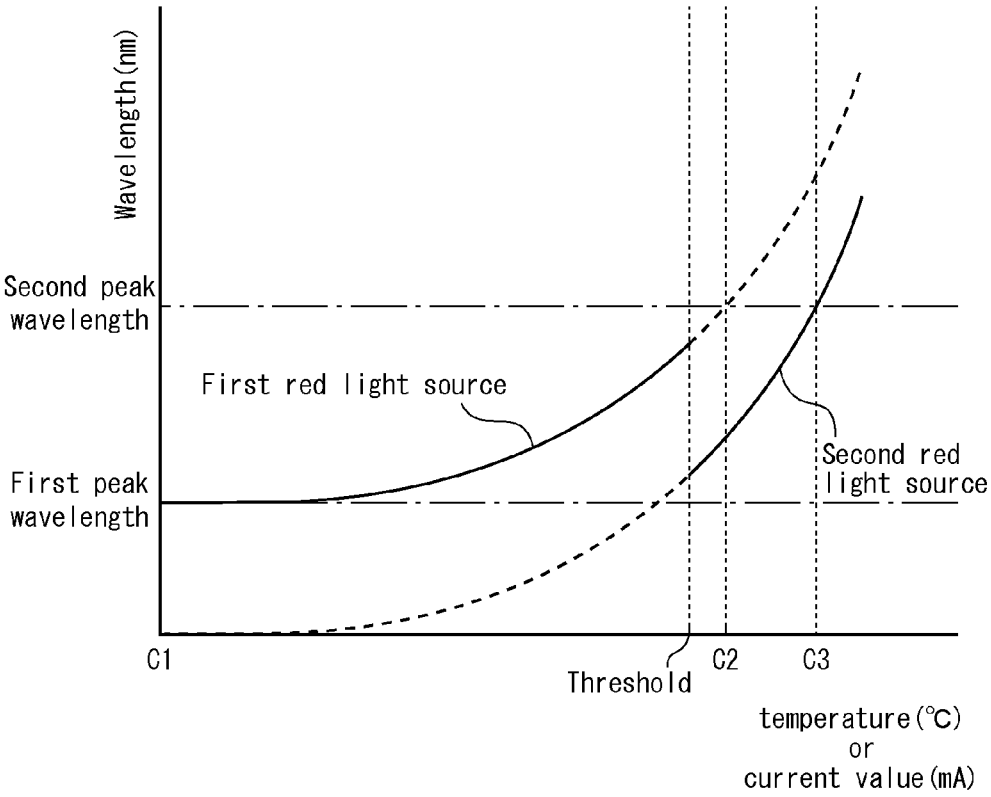
FIG. 13 describes the timing for switching in the red light source switching control pertaining to the variation of the disclosure.

FIG. 12 describes the spectral properties of the first and second red light sources pertaining to the aspect of the disclosure. FIG. 13 describes the timing for switching in the red light source switching control pertaining to the aspect of the disclosure.

As depicted in FIG. 12, when the peak wavelength of the second red light produced by the second red light source R2 is already closer to longer wavelengths than the first peak wavelength of the first red light before the second lighting conditions are reached, then the red light source may be switched from the first red light source R1 to the second red light source R2 before the second lighting conditions are reached. That is, the temperature threshold may be set lower than the second temperature, and the current threshold may be set lower than the second current.

In such circumstances, as depicted in FIG. 13, the first red light source R1 is lit during the transition from the first lighting conditions C1 to below the threshold (depicted as a solid line), and is not lit when the threshold is reached and exceeded despite the second lighting conditions C2 not being reached (depicted as a dashed line). Conversely, the second red light source R2 is not lit during the transition from the first lighting conditions C1 to below the threshold (depicted as a dashed line), and is lit when the threshold is reached and exceeded, despite the second lighting conditions C2 not being reached (depicted as a solid line).

Also, in the above-described Embodiment, the first red light source R1 and the second red light source R2 are not actively lit at the same time. However, during the transition from the first lighting conditions to the second lighting conditions, a third state may be provided in which the first red light source R1 and the second red light source R2 are lit at the same time. This provides a buffer against a sudden change in lighting conditions and enables discomfort accompanying the change in white light source to be slightly reduced. In the third state, dimming control is beneficially performed such that the total brightness of the first red light source R1 and the second red light source R2 is equal to the brightness of the first red light source R1 under the first lighting conditions or to the brightness of the second red light source R2 under the second lighting conditions.

Also, in the above-described Embodiment, the second red light source R2 is not lit under the first lighting conditions, in which the first red light source R1 produces the first red light having the first peak wavelength. However, the second red light source R2 may be faintly lit, to an extent that does not substantially affect the appearance of objects (e.g., the FCI). Furthermore, in the above-described Embodiment, the first red light source R1 is not lit under the second lighting conditions, in which the first red light source R1 produces the first red light having the second peak wavelength that is shifted toward longer wavelengths relative to the first peak wavelength. However, the first red light source R1 may be faintly lit, to an extent that does not substantially affect the appearance of objects (e.g., the FCI).

Finally, the switching of the white light source may also be performed in accordance with another cause unrelated to the temperature and the current, such as a third light-emitting element having a peak wavelength that is shifted toward longer wavelengths.

(Light-Emitting Module)

The light emitting module of the present disclosure is not limited to the light emitting module 10 pertaining to the above-described Embodiment.

For example, in the above-described Embodiment, two each of the first red light source and of the second red light source are provided along with four of the white light source. However, the respective quantities of the light sources are arbitrary. For example, one light source of each color may be provided, or some other quantity thereof maybe provided. Also, the same quantity of light sources need not be provided for each color. The quantities are arbitrary as long as at least one light source of each color is present.

Additionally, in the above-described Embodiment, 18 of the light-emitting elements are sealed by a single sealer member. However, the quantity of the light-emitting elements sealed by a single sealer member is arbitrary. For example, a single sealer member may seal one light-emitting element, or a single sealer member may seal a quantity of light-emitting elements other than 18.

In addition, in the above-described Embodiment, the light-emitting module may include a light source of a color other than white, the first red, and the second red.

Also, in the above-described Embodiment, the red light source block R and the white light source W each have an elongated, straight-linear shape. However, the respective shapes of the red light source block R, the white light source W, the first red light source R1, and the second red light source R2 are arbitrary. That is, each light source need not necessarily have the shape of a straight line, and may have the shape of a curved line. Furthermore, each light source may have a block shape. Further still, the shapes of a straight line, a curved line, and a block may be combined. In addition, the arrangement of the red light source block R, the white light source W, the first red light source R1, and the second red light source R2 is also arbitrary.

Variations in the shape and arrangement of the light sources R1, R2, and W are described below. Note that materials that are the same as those already described have the same reference signs as those already described, and accordingly description thereof is simplified or omitted. For ease of understanding of the arrangement of light sources R1, R2, and W, the drawings depict the light sources R1, R2, and W with matching patterns for components of the same color and different patterns for components of different colors.

Figure 14A:
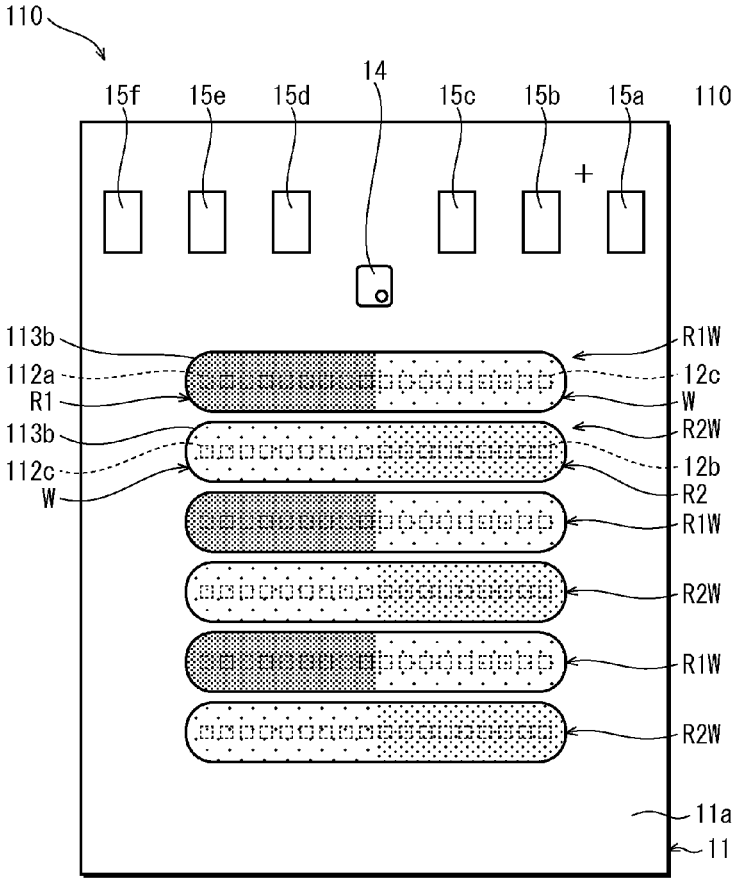
FIGS. 14A, 14B, and 14C depict a light-emitting module pertaining to Variation 1, FIG. 14A being a plan view, FIG. 14B being a right-side view, and FIG. 14C being a front view.
Figure 14B:
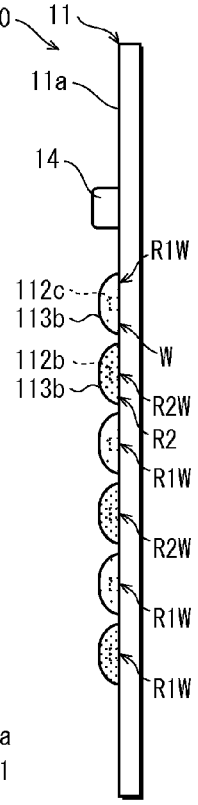
Figure 14C:
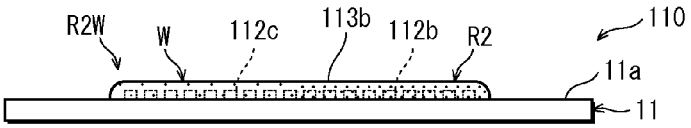

FIGS. 14A, 14B, and 14C depict the light-emitting module pertaining to Variation 1, FIG. 14A being a plan view, FIG. 14B being a right-side view, and FIG. 14C being a front view. For instance, in the light-emitting module 110 pertaining to Variation 1 depicted in FIGS. 14A, 14B, and 14C, a first red-white light source block R1W is configured from the first red light source R1 and the white light source W, and a second red-white light source block R2W is configured from the second red light source R2 and the white light source W. The first red-white light source block R1W and the second red-white light source block R2 each have an elongated shape, six of these components being arranged in parallel with equal spacing therebetween so that both edges are uniform. Also, the first red-white light source block R1W and the second red-white light source block R2W are arranged in alternation with respect to the row direction.

The first red-white light source block R1W includes nine of the first red light-emitting element 112*a*, nine of the white light-emitting element 112*c*, and one sealer member 113*b* sealing the light-emitting elements 112*a* and 112*c*. The sealer member 113*b* is formed from a translucent material having a wavelength converter material therein. Thus, the red light-emitting elements and the white light-emitting elements may be sealed by a single sealer member. In such circumstances, the wavelength converter material may be combined with the translucent material in the portion of the sealer member that seals the white light-emitting elements only. This makes discoloration due to locally-concentrated red light sources less likely when the quantity of the first red light source R1 and of the second red light source R2 is increased.

Figure 15A:
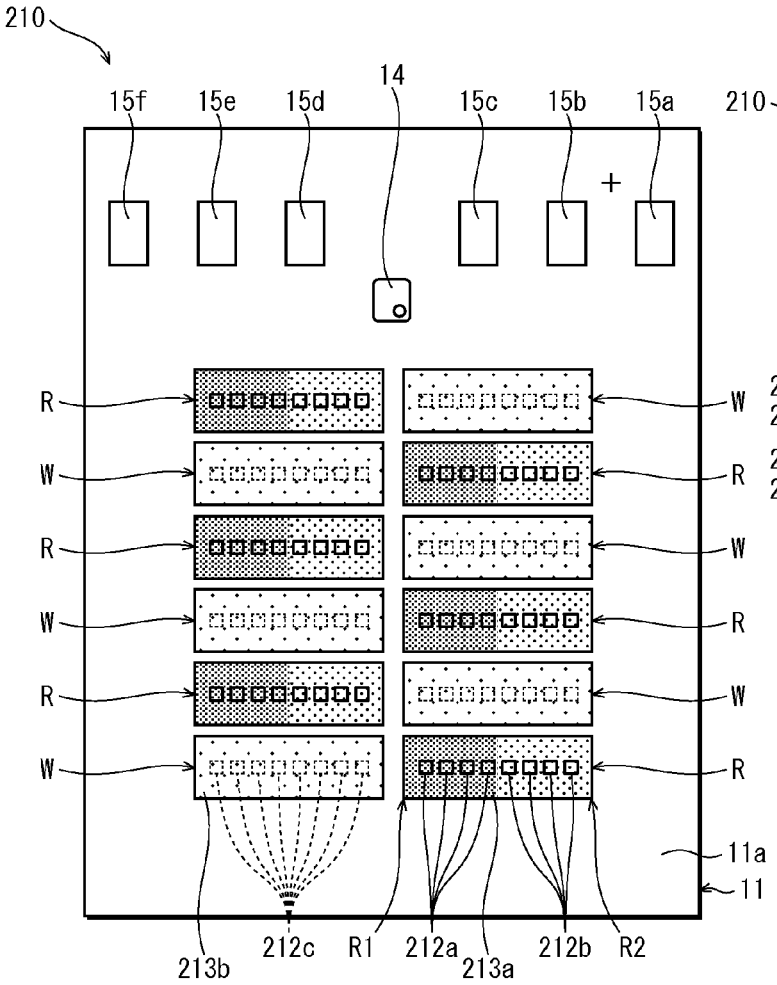
FIGS. 15A, 15B, and 15C depict a light-emitting module pertaining to Variation 2, FIG. 15A being a plan view, FIG. 15B being a right-side view, and FIG. 15C being a front view.
Figure 15B:
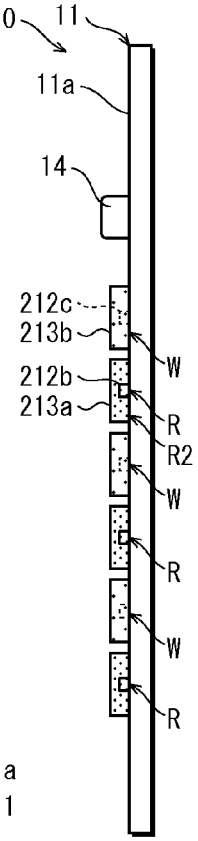
Figure 15C:
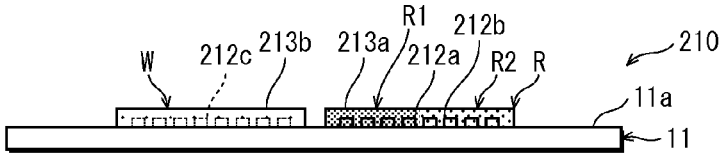

FIGS. 15A, 15B, and 15C depict the light-emitting module pertaining to Variation 2, FIG. 15A being a plan view, FIG. 15B being a right-side view, and FIG. 15C being a front view. For example, the light-emitting module 210 pertaining to Variation 2 as depicted in FIGS. 15A, 15B, and 15C has the red light source block R and the white light source W shaped as rectangles, which are a type of block. These rectangles are arranged in a matrix.

The red light source block R is configured from four of the first red light-emitting element 212*a*, four of the second red light-emitting element 212*b*, and one first sealer member 213*a*. The first sealer member 213*b* is formed from a translucent material having a wavelength converter material therein. The white light source W is configured from eight of the white light-emitting element 212*c* and one second sealer member 213*b*. The second sealer member 213*b* is formed from a translucent material having a wavelength converter material therein.

Then, the red light source block R and the white light source W are arranged in a zig-zag pattern such that no neighboring pairs of the same color occur. As such, reducing the size of the red light source block R and the white light source W while increasing the quantity of the red light source block R and the white light source W evenly combines the light from the red light source block R and the white light source W, making discoloration less likely to occur.

Figure 16A:
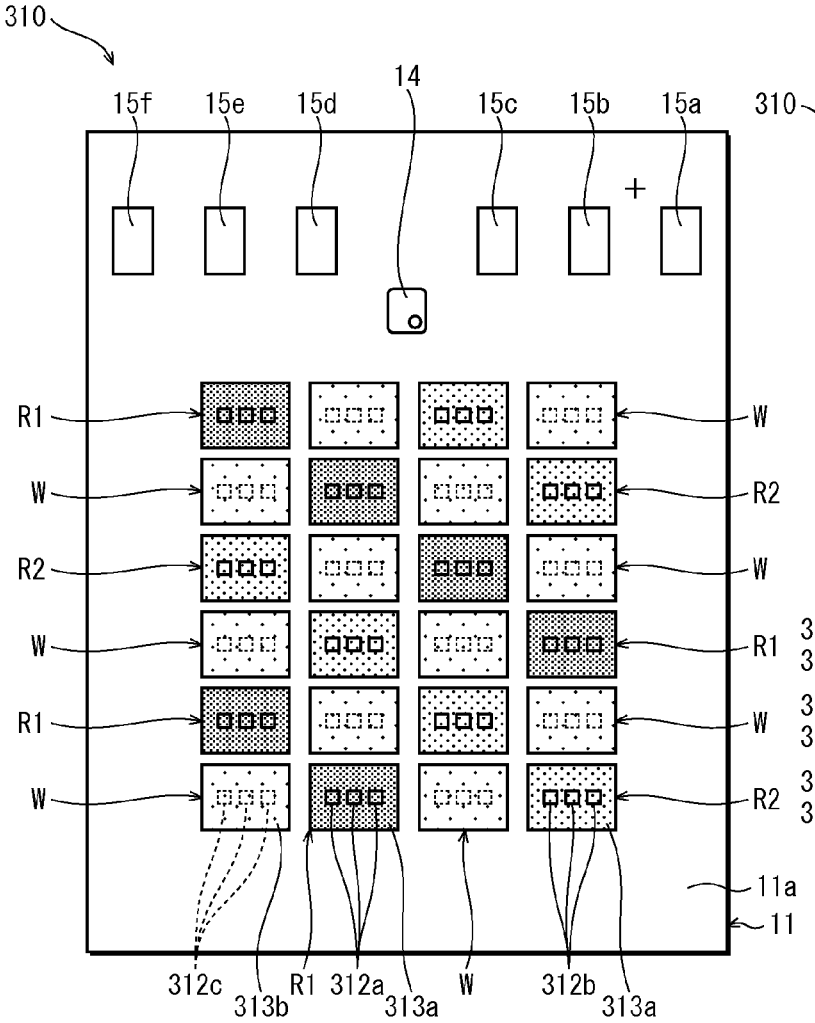
FIGS. 16A, 16B, and 16C depict a light-emitting module pertaining to Variation 3, FIG. 16A being a plan view, FIG. 16B being a right-side view, and FIG. 16C being a front view.
Figure 16B:
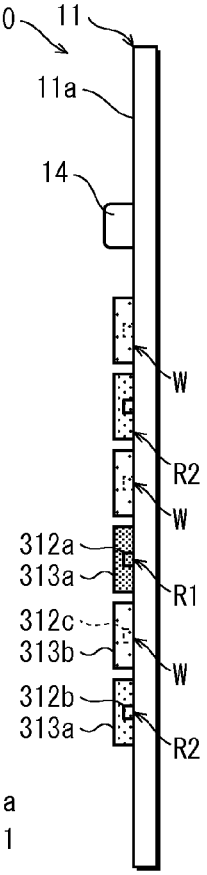
Figure 16C:
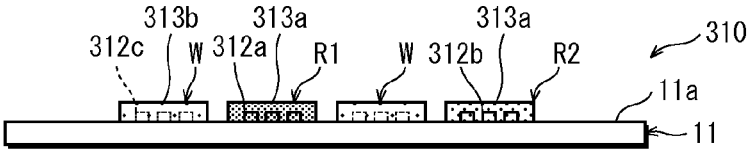

FIGS. 16A, 16B, and 16C depict the light-emitting module pertaining to Variation 3, FIG. 16A being a plan view, FIG. 16B being a right-side view, and FIG. 16C being a front view. For instance, the light-emitting module 310 pertaining to Variation 3 as depicted in FIGS. 16A, 16B, and 16C includes the first red light source R1 and the second red light source R2 connected by a light source of a different color, each being present independently. That is, the first red light source R1 is configured from three of the first red light-emitting element 312*a* and one first sealer member 313*a* sealing the first red light-emitting elements 312*a*. The second red light source R2 is configured from three of the second red light-emitting element 312*b* and one first sealer member 313*a* sealing the second red light-emitting elements 213*b*. The white light source W is configured from three of the white light-emitting element 312*c* and one second sealer member 313*b*. Here, the wavelength converter material is not combined with the translucent material forming the first sealer member 313*a*, and the wavelength converter material is combined with the translucent material forming the second sealer member 313*b*.

The light sources R1, R2, and W are each shaped as rectangles, which are a type of block, and arranged as a matrix. The light sources R1, R2, and W are then arranged in a zig-zag pattern such that no neighboring pairs are of the same color. As such, reducing the size of the individual light sources R1, R2, and W while increasing the quantity of the light sources R1, R2, and W evenly combines the light from the light sources R1, R2, and W, making discoloration less likely to occur.

Figure 17A:
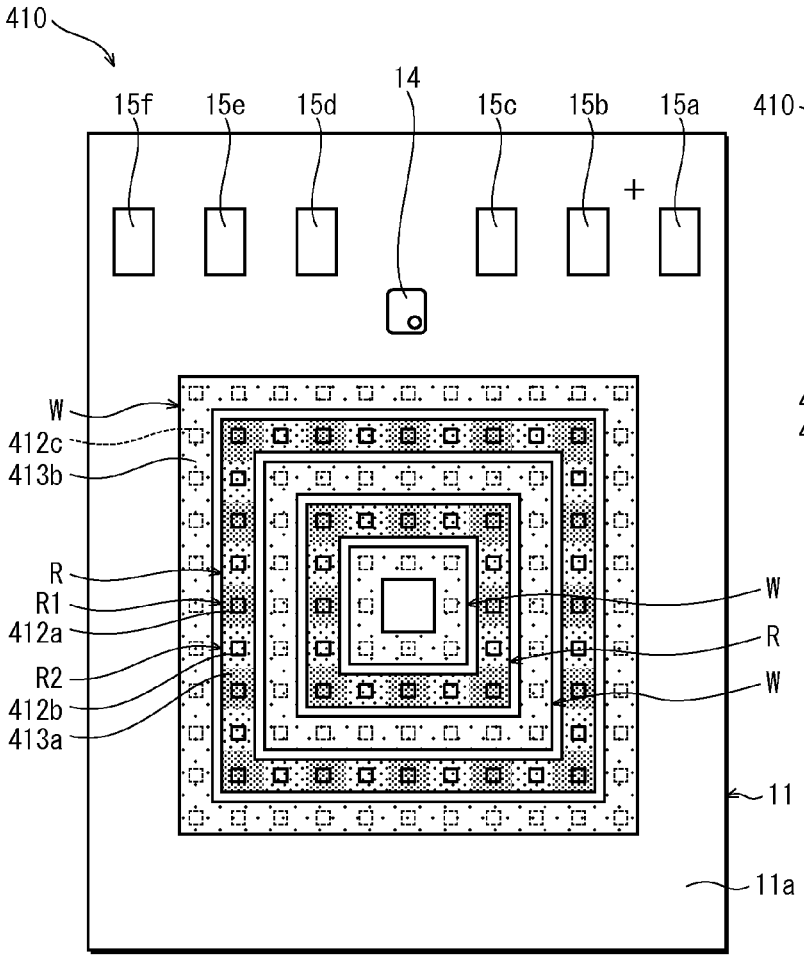
FIGS. 17A, 17B, and 17C depict a light-emitting module pertaining to Variation 4, FIG. 17A being a plan view, FIG. 17B being a right-side view, and FIG. 17C being a front view.
Figure 17B:
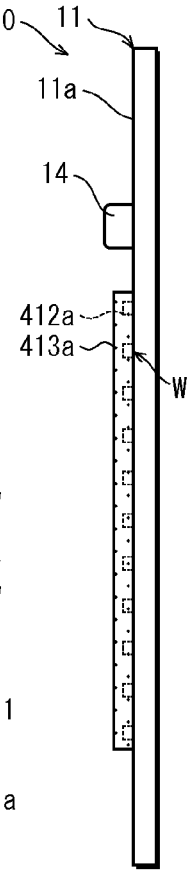
Figure 17C:
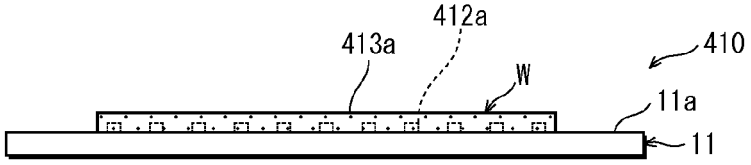

FIGS. 17A, 17B, and 17C depict the light-emitting module pertaining to Variation 4, FIG. 17A being a plan view, FIG. 17B being a right-side view, and FIG. 17C being a front view. In the light-emitting module 410 pertaining to Variation 4 as depicted in FIGS. 17A, 17B, and 17C, a red light source block R, configured from the first red light source R1 and the second red light source R2, and the white light source W are rectangularly annular and are arranged in alternation about a common annular axis.

The red light source block R is configured from a plurality of the first red light source R1 and a plurality of the second red light source R2. These first red light sources R1 and second red light sources R2 are arranged in alternation along a single row. Each of the first red light source R1 is configured from one of the first red light-emitting element 412*a* and one first sealer member 413*a* sealing the first red light-emitting element 412*a*. The second red light source R2 is configured from one of the second red light-emitting element 412*b* and one first sealer member 413*a* sealing the second red light-emitting element 412*b*. The first sealer member 413*b* is formed from a translucent material having a wavelength converter material therein.

The white light source W is configured from a plurality of the white light-emitting element 412*c*, arranged in a ring, and one second sealer member 413*b* that is rectangularly annular and seals the white light-emitting elements 412*c*. The second sealer member 413*b* is formed from a translucent material having a wavelength converter material therein.

As such, making the light sources R1, R2, and W annular enables illumination light to be produced with no discoloration for 360° around the annular axis.

Figure 18A:
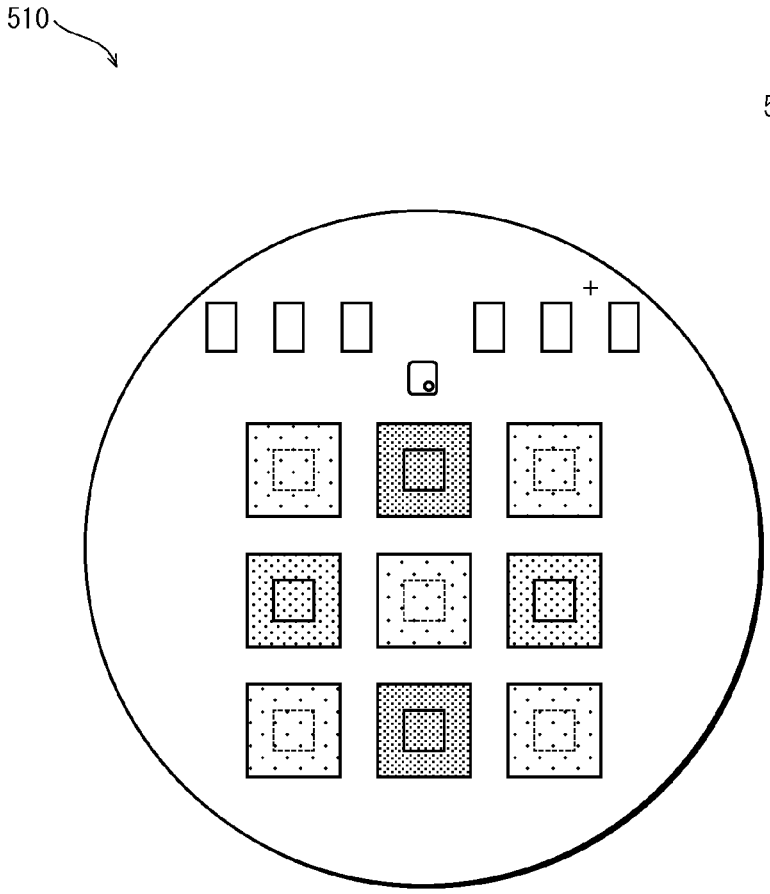
FIGS. 18A, 18B, and 18C depict a light-emitting module pertaining to Variation 5, FIG. 18A being a plan view, FIG. 18B being a right-side view, and FIG. 18C being a front view.
Figure 18B:
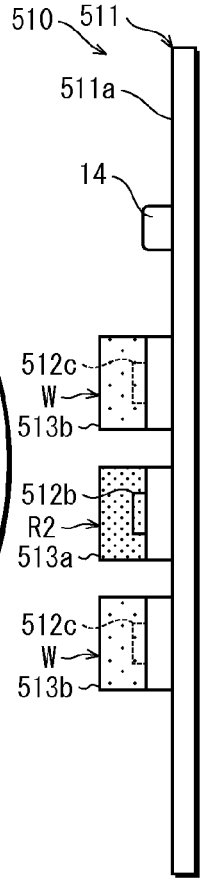
Figure 18C:
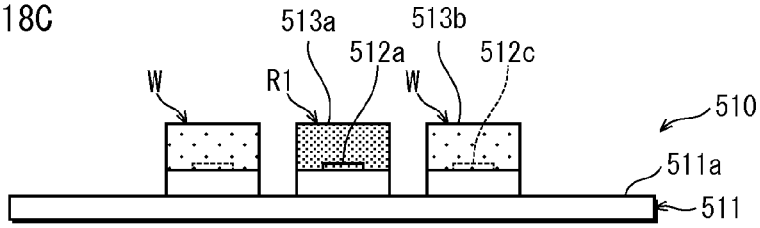

FIGS. 18A, 18B, and 18C depict the light-emitting module pertaining to Variation 5, FIG. 18A being a plan view, FIG. 18B being a right-side view, and FIG. 18C being a front view. The light-emitting module 510 pertaining to Variation 5 depicted in FIGS. 18A, 18B, and 18C has the light sources R1, R2, and W arranged as surface-mounted devices (hereinafter, SMD) on an upper surface 511*a* of a substrate 511 that is a disc. The light sources R1, R2, and W are shaped as substantially square dots as seen in a plan view from above the substrate 311.

The first red light source R1 is configured from a first red light-emitting element 512*a* and a first sealer member 513*a* that is formed from a translucent material having no wavelength converter material mixed therein. The second red light source R2 is configured from a second red light-emitting element 512*b* and the first sealer member 513*a*. The white light source W is configured from a white light-emitting element 512*c* and a second sealer member 513*b* formed from a translucent material having a wavelength converter material combined therewith. The light sources R1, R2, and W are arranged in a zig-zag pattern such that no neighboring pairs are of the same color. Thus, the light produced by the light sources R1, R2, and W is uniform and less prone to discoloration.

(Lighting Device)

The illumination device of the present disclosure is not limited to the lighting device 6 pertaining to the above-described Embodiment.

For example, in the above-described Embodiment, the illumination device of the disclosure is described as a lamp unit adapted to a downlight. However, no such limitation to the form of the illumination device is intended. For example, the illumination device may be adapted to a straight-tube LED lamp or to an LED bulb, which are expected to replace straight-tube fluorescent lamps as described below. The straight-tube LED lamp is an LED lamp that has substantially the same shape as a conventional general straight-tube fluorescent lamp using electrode coils. The LED bulb is an LED lamp that has substantially the same shape as a conventional incandescent bulb.

Figure 19:
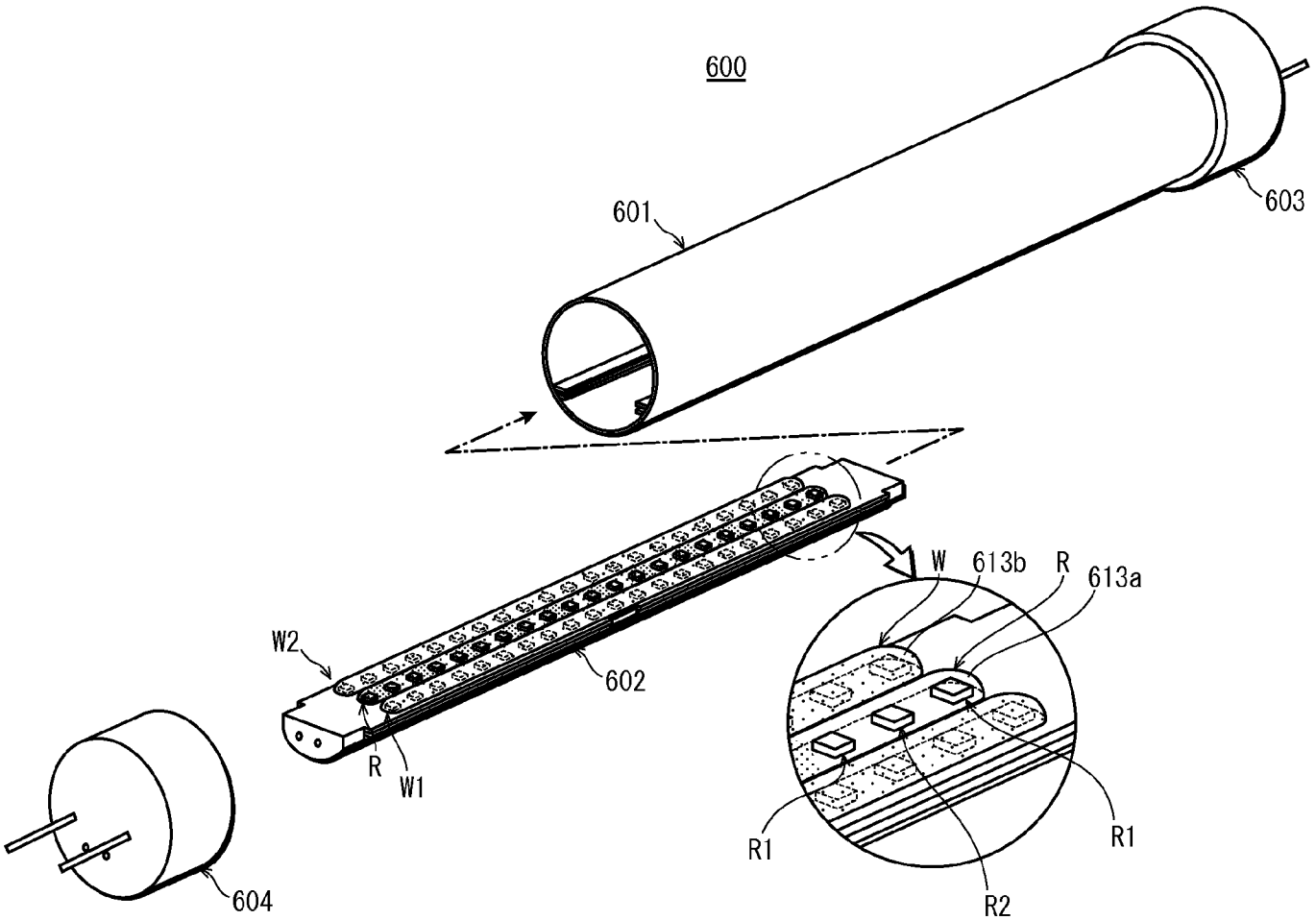
FIG. 19 depicts an illumination device pertaining to Variation 6.

FIG. 19 depicts an illumination device pertaining to Variation 6. As depicted in FIG. 19, a lighting device 600 includes a casing 601 shaped as an elongated tube, a mount 602 arranged within the casing 601, the red light source block R and the white light source W mounted on the mount 602, and a pair of bases 603 and 604 affixed to the two ends of the casing 601.

The casing 601 has an elongated shape with openings at both ends, and contains the red light source block R and the white light source W as well as the mount 402. Although the material of the housing 601 is not particularly limited, a light-transmissive material is preferable. Examples of the light-transmissive material include resin such as plastic, glass, or the like. No particular limitation is intended to the cross-sectional shape of the casing 601, which may be annular or polygonal.

The mount 602 is an elongated plate extending to the vicinity of the bases 603 and 604 at each end. The longitudinal length of the mount 602 is substantially equal to the longitudinal length of the casing 601. The mount 602 beneficially serves as a heat sink dissipating heat from the red light source block R and the white light source W and is thus beneficially formed from a material having high thermal conductivity, such as metal.

The red light source block R is elongated along the longitudinal direction of the mount 602, and is configured from the first red light source R1 and the second red light source R2 arranged in alternation in a single row. The first red light source R1 is configured from a first red light-emitting element 612*a* and a first sealer member 613*a* that is formed from a translucent material having no wavelength converter material mixed therein. The second red light source R2 is configured from a second red light-emitting element 612*b* and the first sealer member 613*a*.

The white light source W is configured from a plurality of white light-emitting elements 612*c* arranged in a single straight line along the longitudinal direction of the mount 602, and a second sealer member 613*b* that is elongated in shape and seals the white light-emitting elements 612*c*. The second sealer member 613*b* is formed from a translucent material having a wavelength converter material therein. Two of the white light source W are provided, being arranged in parallel with equal spacing on both sides of the red light source block R. The light sources R1, R2, and W function identically to the light sources R1, R2, and W of the above-described Embodiment. The lighting device 600 is able to produce illumination light having a stable FCI unaffected by the lighting conditions by performing white light source switching control on the light sources R1, R2, and W similar to that of the above-described Embodiment.

The pair of bases 603 and 604 are affixed to sockets of (non-diagrammed) lighting equipment. Power is supplied to the light sources R1, R2, and W through the pair of bases 603 and 604 with the lighting device 600 affixed to the lighting equipment. Also, heat generated by the light sources R1, R2, and W is conducted to the lighting equipment via the mount 602 and the pair of bases 603 and 604.

Figure 20:
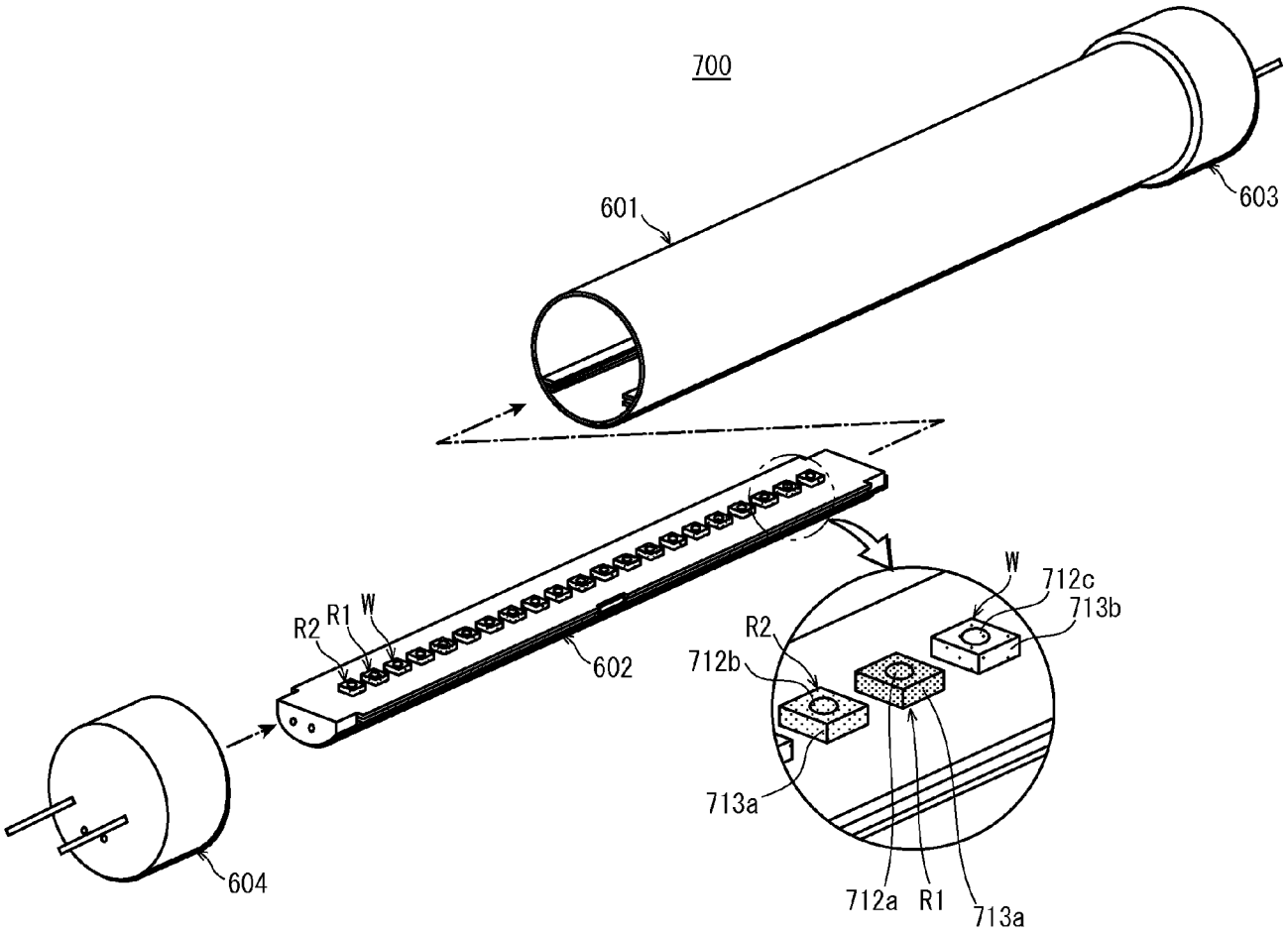
FIG. 20 depicts an illumination device pertaining to Variation 7.

FIG. 20 depicts a lighting device pertaining to Variation 7. As depicted in FIG. 20, a lighting device 700 includes the casing 601, the mount 602, and the pair of bases 603 and 604 similarly to Variation 6, and has a plurality of the power sources R1, R2, and W mounted on the mount 602.

The light sources R1, R2, and W pertaining to the present variation are SMDs. The first red light source R1 is configured from a first red light-emitting element 712*a* and a first sealer member 713*a* that is formed from a translucent material having no wavelength converter material mixed therein. The second red light source R2 is configured from a second red light-emitting element 712*b* and the first sealer member 713*a*. The white light source W is configured from a white light-emitting element 712*c* and a second sealer member 713*b* formed from a translucent material having a wavelength converter material combined therewith.

The light sources R1, R2, and W are arranged as straight lines along the longitudinal direction of the mount 602 with equal spacing therebetween, such that no neighboring pairs of the same color light source R1, R2, and W occur. The light sources R1, R2, and W function identically to the light sources R1, R2, and W of the above-described Embodiment. The lighting device 700 is able to produce illumination light having a stable FCI unaffected by the lighting conditions by performing white light source switching control on the light sources R1, R2, and W similar to that of the above-described Embodiment.

Figure 21:
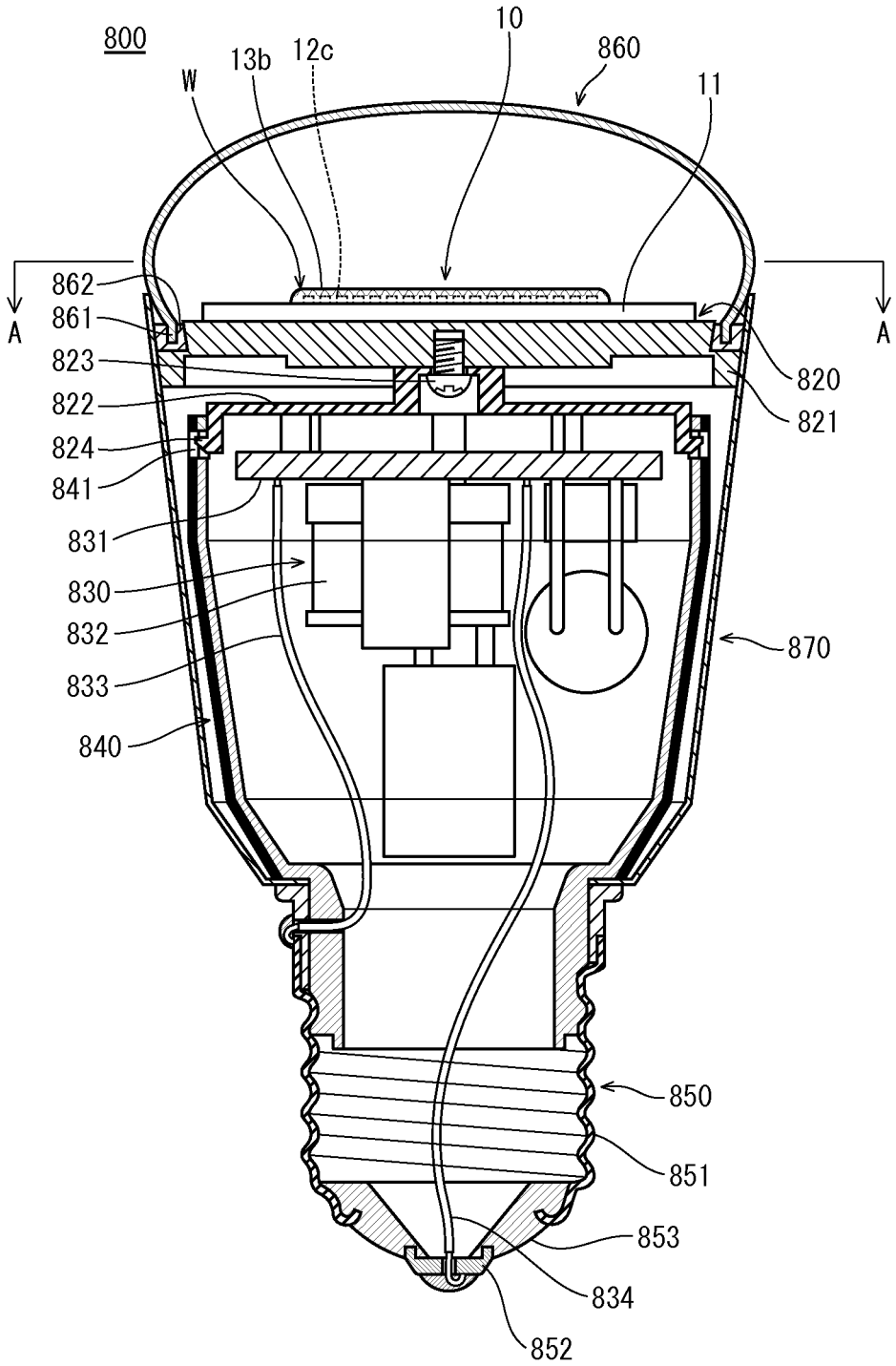
FIG. 21 is a cross-sectional diagram depicting an illumination device pertaining to Variation 8.

FIG. 21 is a cross-sectional diagram depicting a lighting device pertaining to Variation 8. As depicted in FIG. 21, the lighting device 800 pertaining to Variation 8 is an LED bulb that includes a light-emitting module 10, a holder 820, a circuit unit 830, a circuit case 840, a base 850, a globe 860, and a casing 870 as main components.

The light-emitting module 10 is identical to the light-emitting module 10 of the above-described Embodiment, and includes the substrate 11, the light-emitting elements 12*a*, 12*b*, and 12*c*, and the sealer members 13*a* and 13*b* as depicted in FIGS. 7A, 7B, and 7C. The first red light source R1 is configured from the first red light-emitting element 12*a* and the first sealer member 13*a* sealing the first red light-emitting element 12*a*. The second red light source R2 is configured from the first second light-emitting element 12*b* and the first sealer member 13*a* sealing the second red light-emitting element 12*b*. The white light source W is configured from the white light-emitting element 12*c* and the second sealer member 13*b*.

The holder 820 includes a module holder 821 and a circuit holder 822. The module holder 821 is a substantially discoid member for affixing the light-emitting module 10 to the casing 870, is formed from aluminum or a similar material having good thermal conductivity, and also serves as a thermal conduction member conducting heat from the light-emitting module 10 to the casing 870. The circuit holding part 822 is a substantially disc-like part that is made, for example, of synthetic resin. The circuit holding part 822 is fixed to the module holding part 821 by a screw 823. The circuit holding part 822 has an engaging claw 824, which is provided at the periphery thereof and engages with the circuit case 840.

The circuit unit 830 includes a circuit substrate 831 and a plurality of electronic components 832 mounted on the circuit substrate 831, is contained within the casing 870 with the circuit substrate 831 fixed to the circuit holder 822, and is electrically connected to the light-emitting module 10. The circuit unit 830 corresponds to the circuit unit 4 of the above-described Embodiment, in which the lighting circuit 4*c*, the dimming ratio detection circuit 4*d*, the current detector 4*e*, and the control circuit 4 are unified as a lighting circuit. The lighting device 800 is able to produce illumination light having a stable FCI unaffected by the lighting conditions by having the circuit unit 830 perform red light source switching control on the light sources R1, R2, and W similar to that of the above-described Embodiment.

The circuit case 840 is affixed to the circuit holder 822 with the circuit unit 830 contained therein. The circuit case 840 has an engaging hole 841 for engagement with the engaging claw 824 of the circuit holding part 822. The circuit case 840 is fixed to the circuit holding part 822 by engagement of the engaging claw 824 with the engaging hole 841.

The base 850 is a base defined by Japanese Industrial Standards (hereinafter, JIS), such as an Edison screw conforming to the standard, and is used for mounting into a typical incandescent bulb socket (not diagrammed). The base 850 includes a shell 851, which is also referred to as a cylindrical barrel, and an eyelet 852 having a disc-like shape. The base 850 is attached to the circuit case 840. The shell 851 and the eyelet 852 are integrated in one piece, with an insulating part 853 made of glass being interposed therebetween. The shell 851 and the eyelet 852 are electrically connected to a power feed line 833 and a power feed line 834 of the circuit unit 830, respectively.

The globe 860 is substantially dome-shaped, covers the light-emitting module 10, and has an opening end 861 fixed to the casing 870 and to the module holder 821 by an adhesive 862.

The casing 870 is, for example, cylindrical, having the light-emitting module 10 disposed at one opening end thereof and the base 850 disposed at another opening end thereof. The casing 870 is formed from a base material having good thermal conductivity, such as aluminum, in order to serve as a dissipation member (i.e., a heat sink) dissipating heat from the light-emitting module 10.

(Lighting Equipment)

The lighting equipment of the present disclosure is not limited to the lighting equipment 1 pertaining to the above-described Embodiment.

For example, in the above-described Embodiment, the light-emitting module is embedded in the lighting equipment as a part of an illumination device. However, the light-emitting module may also be directly embedded in the lighting equipment, not as part of an illumination device but as a single device itself.

(Lighting Circuit)

In the above-described Embodiment, the entire lighting circuit, including the lighting circuit 4*c*, the dimming ratio detection circuit 4*d*, the current detector 4*e*, and the control circuit 4*f*, is provided outside the lighting device 6 as the circuit unit 4. However, the lighting circuit may also be provided in whole or in part within the lighting device as a portion of the lighting device. That is, the lighting circuit, the dimming ratio detection circuit, the current detector, and the control circuit may all be incorporated in the lighting device, or a subset of one to three of these four components may be incorporated into the lighting device. Also, the lighting circuit may be wholly or partly configured as a portion of the light-emitting module, for example by being built onto the substrate of the light-emitting module. That is, the lighting circuit, the dimming ratio detection circuit, the current detector, and the control circuit may all be part of the light-emitting module, or a subset of one to three of these four components may be part of the light-emitting module.

(Other)

The configuration of the present disclosure has been described above in accordance with the Embodiment and Variations. However, no limitation to the above-described Embodiment and Variations is intended. For example, a configuration partially combining the above-described Embodiment and Variations may be configured as appropriate. In addition, note that the materials, the numerical values, and so on described in the embodiment above are nothing more than preferable examples, and accordingly the present invention is not limited by those described in the Embodiment above. Furthermore, the structure of the present disclosure may be modified according to the need, within the scope of the technical idea of the disclosure. The present invention is broadly utilizable to general intended purpose of lighting.

[Reference Signs List]

| | |
|---|---|
| 1 | Lighting equipment |
| 6, 600, 700, 800 | Lighting device |
| 4, 830 | Lighting circuit (Circuit unit) |
| 10, 110, 210, 310, 410, 510 | Light-emitting module |
| 12b, 112b, 212b, 312b, 412b, 512b, 612b, 712b (Second sealer member) | Wavelength converter member |
| 12c, 112c, 212c, 312c, 412c, 512c, 612c, 712c (White sealer member) | Wavelength converter member |
| R1 | First red light source |
| R2 | Second red light source |
| W | White light source |

The invention claimed is:

1. Lighting equipment, comprising:

a white light source including a light-emitting element and a wavelength converter member performing wavelength conversion on light from the light-emitting element, the white light source producing white light obtained by combining light from the light-emitting element that is converted by the wavelength converter member and light from the light-emitting element that is not converted by the wavelength converter member;

a first red light source producing first red light;

a second red light source producing second red light having an emission peak at a shorter wavelength than the first red light source when lit under similar lighting conditions; and a lighting circuit performing lighting control of the white light source, the first red light source, and the second red light source, wherein the lighting circuit performs control of lighting the first red light source and lighting the white light source while not lighting or faintly lighting the second red light source under first lighting conditions in which the first red light source is expected to produce the first red light with a first peak wavelength, and of lighting the second red light source and lighting the white light source while not lighting or faintly lighting the first red light source under second lighting conditions in which the first red light source is expected to produce the first red light with a second peak wavelength that is shifted toward a longer wavelength relative to the first peak wavelength.

2. The lighting equipment of claim 1, wherein the second red light produced by the second red light source under the second lighting conditions is at least 5 nm shorter in terms of peak wavelength than the first red light produced by the first red light source under the second lighting conditions.

3. The lighting equipment of claim 1, wherein the first red light source has a first temperature under the first lighting conditions, and the first red light source has a second temperature under the second lighting conditions, the second temperature being higher than the first temperature.

4. The lighting equipment of claim 1, wherein a first current flows through the first red light source under the first lighting conditions, and a second current that is greater than the first current flows through the first red light source under the second lighting conditions.

5. The lighting equipment of claim 1, wherein the peak wavelength of the light from light-emitting element is no less than 450 nm and no more than 470 nm.

6. An illumination device, comprising:

a white light source including a light-emitting element and a wavelength converter member performing wavelength conversion on light from the light-emitting element, the white light source producing white light obtained by combining light from the light-emitting element that is converted by the wavelength converter member and light from the light-emitting element that is not converted by the wavelength converter member;

a first red light source producing first red light;

a second red light source producing second red light having an emission peak at a shorter wavelength than the first red light source when lit under similar lighting conditions; and a lighting circuit performing lighting control of the white light source, the first red light source, and the second red light source, wherein the lighting circuit performs control of lighting the first red light source and lighting the white light source while not lighting or faintly lighting the second red light source under first lighting conditions in which the first red light source is expected to produce the first red light with a first peak wavelength, and of lighting the second red light source and lighting the white light source while not lighting or faintly lighting the first red light source under second lighting conditions in which the first red light source is expected to produce the first red light with a second peak wavelength that is shifted toward a longer wavelength relative to the first peak wavelength.

7. A light emitting module, comprising:

a white light source including a light-emitting element and a wavelength converter member performing wavelength conversion on light from the light-emitting element, the white light source producing white light obtained by combining light from the light-emitting element that is converted by the wavelength converter member and light from the light-emitting element that is not converted by the wavelength converter member;

a first red light source producing first red light;

a second red light source producing second red light having an emission peak at a shorter wavelength than the first red light source when lit under similar lighting conditions; and a lighting circuit performing lighting control of the white light source, the first red light source, and the second red light source, wherein the lighting circuit performs control of lighting the first red light source and lighting the white light source while not lighting or faintly lighting the second red light source under first lighting conditions in which the first red light source is expected to produce the first red light with a first peak wavelength, and of lighting the second red light source and lighting the white light source while not lighting or faintly lighting the first red light source under second lighting conditions in which the first red light source is expected to produce the first red light with a second peak wavelength that is shifted toward a longer wavelength relative to the first peak wavelength.

* * * * *